United States Patent [19]

Kamikura et al.

[11] 4,100,768

[45] Jul. 18, 1978

[54] METHOD AND APPARATUS OF SELECTING NEEDLES OF A KNITTING MACHINE

[75] Inventors: Shigeo Kamikura; Hideaki Itagaki; Ryoiti Kawaoka, all of Kodaira, Japan

[73] Assignee: Silver Seiko Co., Ltd., Kodaira, Japan

[21] Appl. No.: 814,534

[22] Filed: Jul. 11, 1977

Related U.S. Application Data

[63] Continuation-in-part of Ser. No. 789,287, Apr. 20, 1977, abandoned, which is a continuation-in-part of Ser. No. 686,380, May 14, 1976, abandoned.

[30] Foreign Application Priority Data

May 24, 1975 [JP] Japan ..... 50-61480

[51] Int. Cl.[2] ..... D04B 7/00; D04B 15/66

[52] U.S. Cl. ..... 66/75.2; 66/154 A

[58] Field of Search ..... 66/75.2, 154 A, 50 R; 340/172.5; 235/151.11

[56] References Cited

U.S. PATENT DOCUMENTS

| | | | |
|---|---|---|---|
| 3,035,426 | 5/1962 | McQueen | 66/75.2 |
| 3,783,642 | 1/1974 | Hadam et al. | 66/75.2 |
| 3,817,059 | 6/1974 | Krause | 66/154 A |
| 3,825,900 | 7/1974 | Anderson | 66/75.2 X |
| 3,885,405 | 5/1975 | Manfred | 66/154 A |
| 3,913,353 | 10/1975 | Spencer | 66/75.2 |
| 3,924,244 | 12/1975 | Seitz | 66/154 A |
| 3,983,718 | 10/1976 | Kahan et al. | 66/75.2 |
| 3,991,552 | 11/1976 | Kahan et al. | 66/75.2 |
| 4,006,611 | 2/1977 | Kahan et al. | 66/75.2 |
| 4,015,445 | 4/1977 | Kahan et al. | 66/75.2 |
| 4,015,446 | 4/1977 | Kagaya | 66/75.2 |
| 4,036,035 | 7/1977 | Kahan et al. | 66/75.2 |
| 4,040,277 | 8/1977 | Kahan et al. | 66/154 A |

*Primary Examiner*—Ronald Feldbaum

*Attorney, Agent, or Firm*—Blanchard, Flynn, Thiel, Boutell & Tanis

[57] ABSTRACT

A new method of selecting knitting needles of a straight knitting machine by scanning a program carrier; producing sampling pulses; taking electric signals obtained as a result of said scanning; storing in a temporary storage a preset number of digital electric signals; reading out, in a cyclic manner, said preset number of digital electric signals in response to carriage movement; and selecting needles according to contents of said preset number of digital electric signals to be cyclically read out, is provided. An improved straight knitting machine to put the new method into practice is also provided. With this new method and the improved straight knitting machine, it has become possible to simplify a recording of the profile indicating the unit pattern and to knit a pattern having a desired profile and size.

21 Claims, 15 Drawing Figures

A

METHOD AND APPARATUS OF SELECTING NEEDLES OF A KNITTING MACHINE

This application is a continuation-in-part of U.S. application Ser. No. 789,287, filed 4/20/77 now abandoned, which in turn is a continuation of U.S. application Ser. No. 686,380, filed 5/14/76, now abandoned.

BACKGROUND OF THE INVENTION

The present invention relates to a method of selecting the needles of a knitting machine, particularly a household hand-knitting machine, and more particularly a method of selecting needles of a knitting machine in order to effect operation of the needles in accordance with a recorded pattern by reading out the recording medium wherein a profile of the pattern to be knitted is permanently stored.

A conventional needle-selecting method is one whereby a profile of the pattern to be knitted is recorded in a card in the form of multistage punched hole configurations. The punched holes of each stage are mechanically detected and mechanically recorded in a mechanical memory in the form of a group of needle-selecting signals. The desired needle group may then be selectively actuated in response to carriage movement.

Such conventional needle-selecting methods are disadvantageous in that the recording operation necessitates minute attention because the punch holes must be arranged in predetermined positions on the card in order to produce a profile of the pattern to be knitted. In other words, the profile representing the unit pattern to be knitted must first be separated beforehand into profile modules (corresponding to the respective aforementioned punched holes, or minimum composite units of the pattern) which must be sequentially arranged for proper recording.

That is, the profile indicating the whole unit pattern must be digitally recorded in the form of profile modules, each corresponding to one needle. Such methods of needle selection, however, have an important drawback in that the number of needles in one group employed in knitting a unit pattern cannot be altered, whereby the size of the unit pattern cannot be freely changed.

SUMMARY OF THE INVENTION

One object of this invention is to provide a novel method of selecting knitting machine needles in which the profile of the unit pattern can be interpreted as digital signals, each representing a needle, after read out. This is accomplished merely by recording the said profile in analog values, and sub-dividing it into profile modules which facilitate simplified recording of the unit pattern.

Another object of the present invention is to provide a method of selecting knitting machine needles in which, in knitting a unit pattern, the number of needles in one group can easily be changed so that a pattern having the desired profile and size can freely be knitted.

In one aspect of the present invention, these and other objects have been attained by a method of selecting knitting needles of a straight knitting machine comprising the steps of: scanning a program carrier, on which a needle selection program is recorded, by use of a scanner, to obtain electric signals; producing sampling pulses, each corresponding to an increment of scanning movement by the scanner, during said scanning of said program carrier; sampling said electric signals by use of said sampling pulses to produce a predetermined number of digital electric signals during one complete stroke of said scanning; storing in a temporary storage at least a preset number of digital electric signals out of said predetermined number of digital electric signals; reading out, in a cyclic manner, said preset number of digital electric signals in response to carriage movement; and selecting needles according to contents of said preset number of digital electric signals to be cyclically read out.

In another aspect of the present invention, these and other objects have been attained by an improved straight knitting machine having a main body provided thereon with a needle bed for knitting needles and a carriage slidably mounted on the needle bed, a patterning system including a pair of needle selection means mounted on said carriage in a spaced relation from each other and each provided with an electromagnet adapted to be controlled by a common control circuit means which includes an erasable temporary storage for signals representative of data for a needle selection program, said signals being read out of said storage in response to carriage movement by a distance equal to a space between two adjacent knitting needles: wherein the improvement comprises a program providing means provided on the main body for providing means including a program carrier carrying thereon a needle selection program, a support on the main body for removably mounting thereon the program carrier and adapted to be driven to incrementally feed same in one or another direction, a scanner mounted for movement in a predetermined path between two end positions thereof and adapted to be moved between both of said two positions in response to each of said carriage movements in either direction, said scanner having thereon a sensor means for reading the needle selection program on the program carrier on the support, and pulse generating means for generating an interval pulse by an increment of the scanner movement to provide a predetermined number of pulses upon a scanner movement between said two end positions; and preset means including a manually operable member and electrically connected to said control circuit means for presetting the number of those signals which are to be cyclically read out of said storage, said number being not larger than said predetermined number.

BRIEF DESCRIPTION OF THE DRAWINGS

Other objects and various advantages and features of the invention will become apparent by reference to the following description taken in connection with the appended claims and the accompanying drawings forming a part thereof.

In the drawings.

DETAILED DESCRIPTION OF A PREFERRED EMBODIMENT

Figure 1:
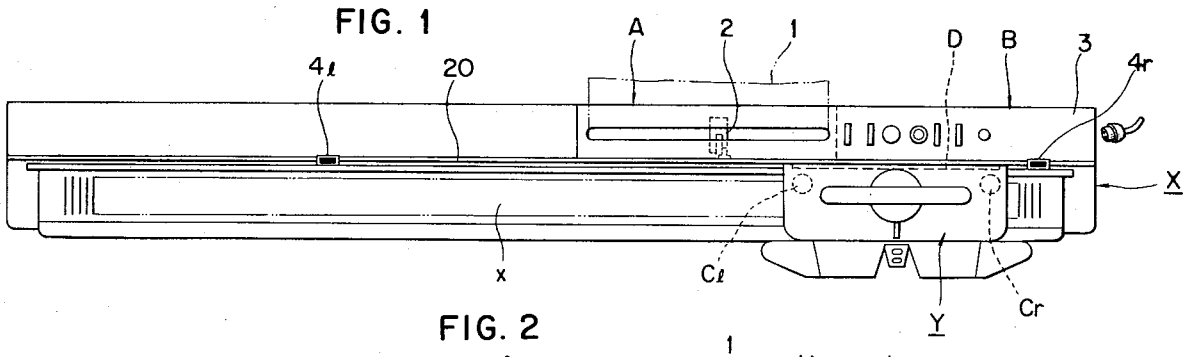
FIG. 1 is a schematic plan view of the whole hand-operated knitting machine according to the present invention.

Referring now to FIG. 1, on a control panel 3 of main body X with needle bed *x*, are provided a program providing means A for providing a needle selection program including a program carrier 1 carrying thereon a needle selection program and a scanner 2 for optically scanning the knitting pattern recorded on the program carrier 1, and operating means adapted to operate various kinds of mechanisms, which will be described later, besides the program providing means A on the control panel 3 of the main body X with the needle bed *x*. Further, behind the needle bed *x* of the machine, there are provided a control box B including various kinds of electric or electronic circuits as described later, and a pair of left and right boundary members $4_l$ and $4_r$, shiftable along a longitudinal direction of the needle bed *x*, adapted to define a range in which needle election is to be effective by setting them at desired positions of the longitudinal direction. There are provided a pair of left and right needle selecting mechanisms Cl and Cr, each having an electromagnet for needle selection use, on the carriage Y with a predetermined spacing therebetween along a longitudinal direction. Either one of the left and right needle selecting mechanisms Cl and Cr are adapted to effectively actuate the needles (not shown in FIG. 1) aligned in the needle bed *x* by means of electromagnetic force responsive to electric signals obtained through scanning of said knitting pattern.

The scanner 2 is mounted for movement in a predetermined path between two end positions thereof and adapted to be moved between both of said two positions in response to each of said carriage movements in either direction, and scans a needle selection program recorded on the program carrier 1 during carriage movement along the defined range the output electric signals in accordance with said scanning operation, and the processing thereafter of said output electric signal can be electronically effected by a control circuit. Power may be supplied to the electric components of either one of needle selecting mechanisms Cl and Cr for effecting the knitting operation effectively from the machine body X through the current collector means D arranged longitudinally on the back of the carriage Y. In this embodiment, the mechanism located ahead in terms of carriage movement is supplied with power. Only the needles positioned in the range defined by said boundary members $4_l$ and $4_r$ will be actuated selectively. (In this range, however, needles at rest positions are not subjected to the needle selection.)

A significant construction of said program providing means A will be described below referring to FIGS. 2 through 4.

A support 5 for holding the afore-mentioned program carrier 1 in a U-shaped configuration and for incrementally feeding same in a direction, is mounted in parallel with said needle bed *x*, rotatably on a frame 6. Front and rear guide bars $7_1$ and $7_2$ are mounted horizontally on the frame 6 under the support 5, the scanner 2 is mounted on the frame 6 so as to run along the longitudinal direction.

Figure 4:
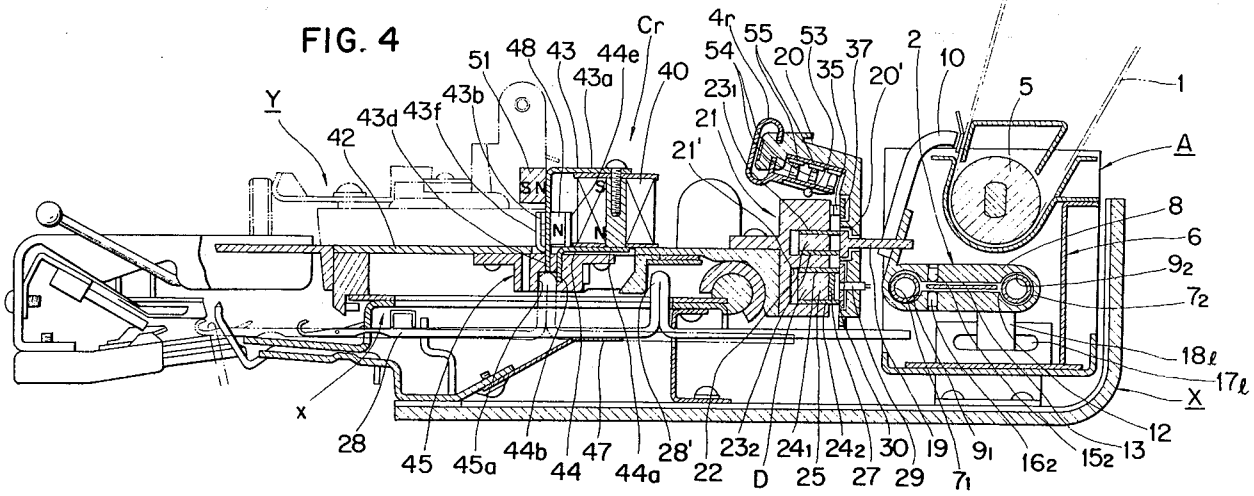
FIG. 4 is a sectional view illustrating the knitting machine including the program providing means and an electromagnet for needle selection.

Namely, as illustrated in FIG. 4, the guide bars $7_1$ and $7_2$ slidably engage transverse holes $9_1$ and $9_2$ provided at the front and rear portions of a scanning member 8.

At the top end of the scanner is provided a photoelectric detecting mechanism, that is, a pipe scanner 10 with a luminous element and a light sensitive element to convert into an electric signal, the reflective light which is emitted from said luminous element and is reflected from one face of the program carrier 1, and the pipe scanner 10 serves to scan the program carrier 1 from side to side.

In space between the left and right perforations 1' adapted to engage pins of a known pin drum to the program carrier 1, a column $11_1$ for recording a desired knitting pattern thereon and columns $11_2$ and $11_3$ for recording desired function marks thereon are formed by section dividing lines drawn in the color similar to that of said luminous element mounted on the scanner 10 and not discriminated by said light sensitive element (for example, red, when a red luminous diode is employed as the luminous element).

In the column $11_1$ for recording a knitting pattern thereon, a vertical line of said section dividing lines corresponds to the division line of each wale, while a transverse line of same corresponds to a division of each knitting operation stage, and numerals indicating said wale and said course are given in a color similar to that employed in the section dividing line, in positions outside the column.

Figure 2:
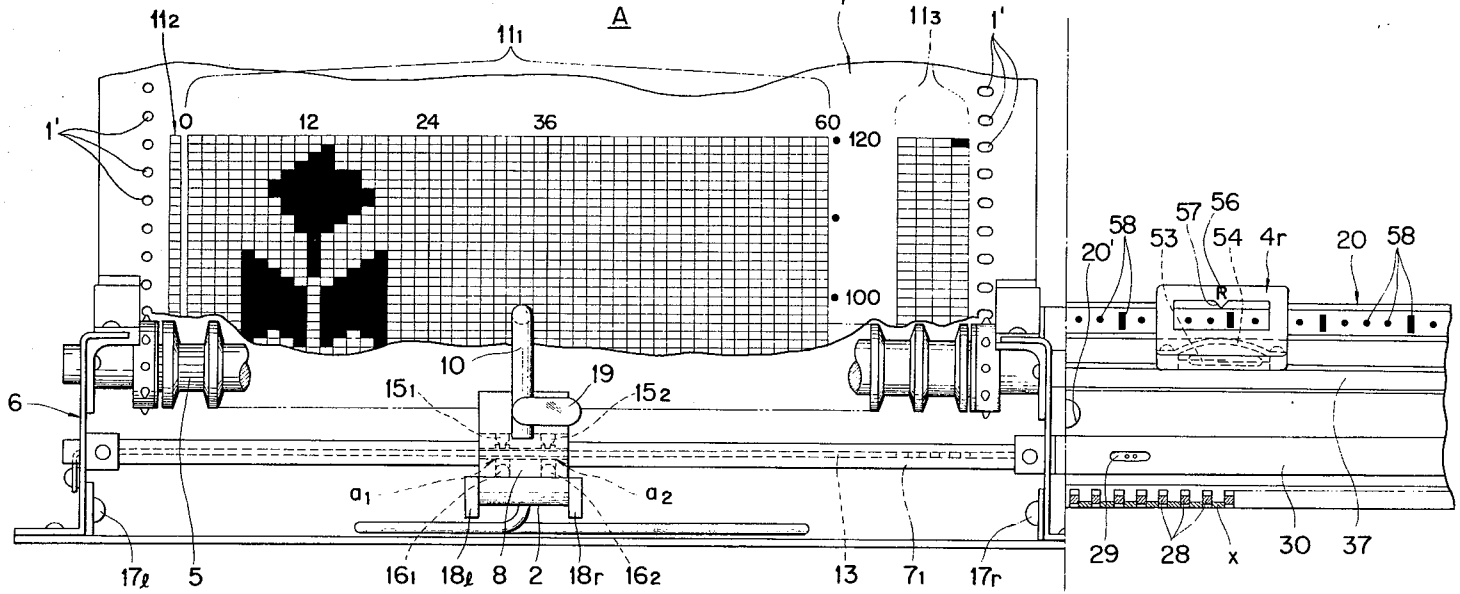
FIG. 2 is an elevational view of the knitting machine illustrating a program providing means and an electronic wall on the main body.
Figure 3:
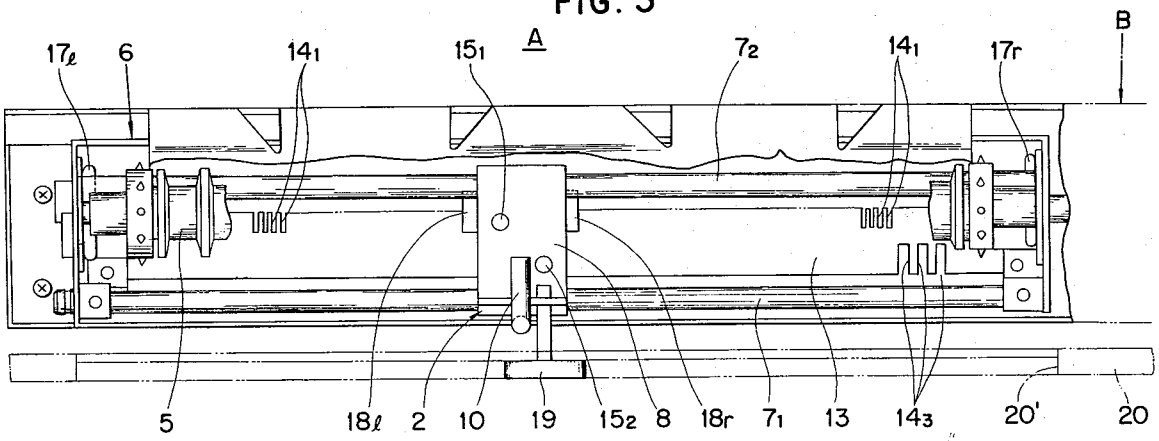
FIG. 3 is a partly exploded plan view of said program providing means.

According to a more detailed description, the column $11_1$ may be formed so that the minimum section thereof corresponds to one stitch, to wit, one section in its transverse arrangement corresponds to each wale, while one section in its vertical arrangement corresponds to each course, and in knitting the unit pattern involving a given number of wales at the transverse line as one group unit, the desired pattern will be obtained by drawing a picture corresponding to the unit pattern to be knitted in the area defined by the vertical line at the extreme left and another vertical line positioned from the former by the given number of wales and in black as illustrated in FIG. 2, by means of appropriate writing tools.

For example, when the operation for knitting the unit pattern involving 24 wales is intended by selecting 24 needles as one group unit, a desired picture can be drawn in the space defined by the vertical line at the extreme left end and the other vertical line as distant as to 24 lines to the right from the former.

In the process, so long as the profile of the picture is within the predetermined area as described above, the picture may generally be drawn by a writing tool without inking in said minimum sections one by one. This is because reading out is effected by sampling each unit section.

In the embodiment shown in FIG. 2, the column $11_2$ of the program carrier 1 comprises a single subcolumn, while the column $11_3$ comprises four subcolumns, and the scanner 2, when positioned at the leftmost and rightmost end positions thereof, reads the column $11_2$ and the rightmost subcolumn of the column $11_3$, respectively.

In effecting the desired functional operation, appropriate unit sections of the columns $11_2$ and $11_3$ for recording function marks therein are to be completely inked in.

When the program carrier 1 may be, for example, shifted to a desired position the program carrier 1 is automatically fed by one increment after the scanner 2 has completed one scanning stroke as will be described later, the unit section as a function mark corresponding to a signal source is inked in (for example, in black) to provide instructions that the needle selecting operation should be suspended substantially during scanning after that time, or the program carrier 1 is to be automatically returned to a predetermined position, or an appropriate alarm is to be actuated.

Figure 11:
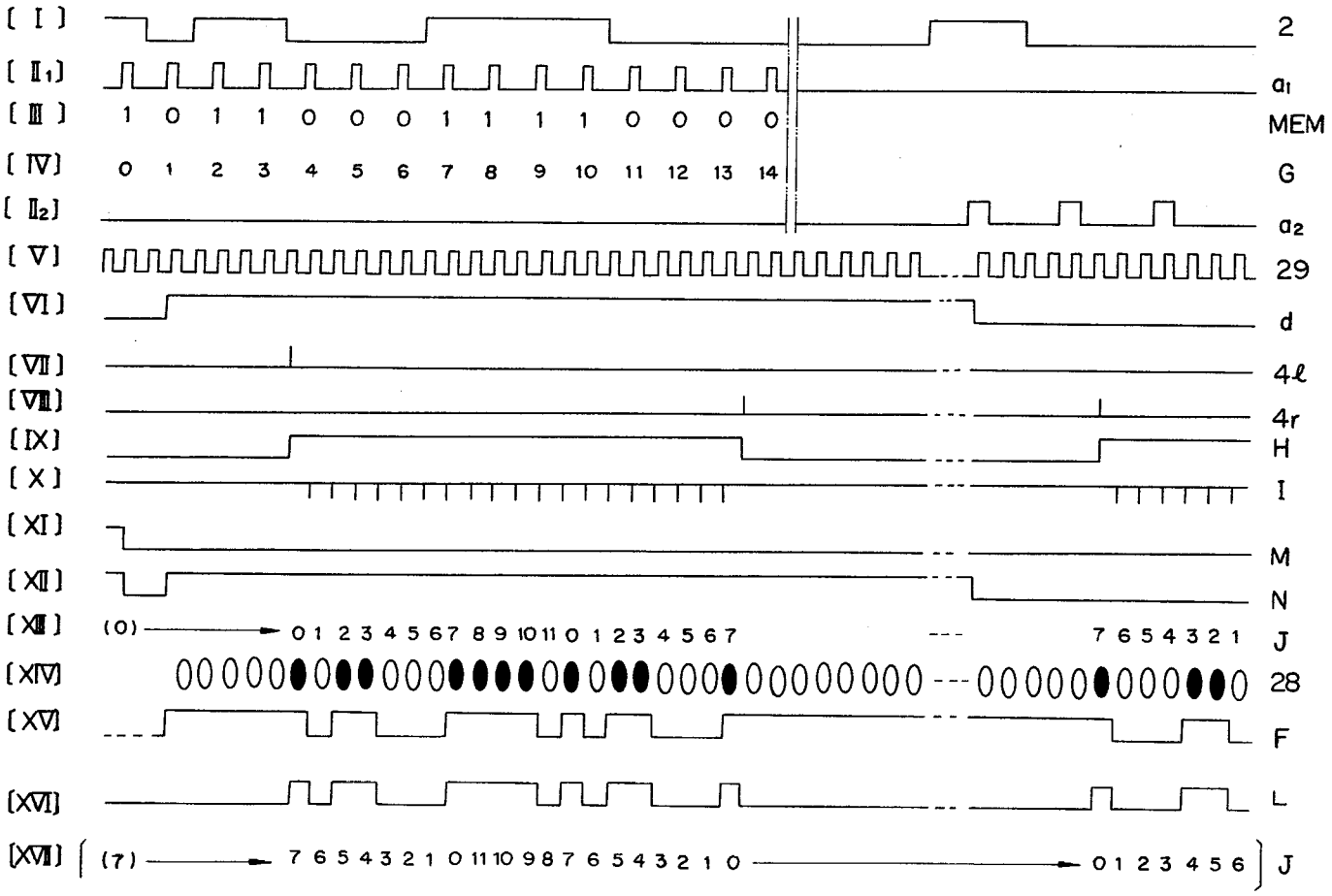

As stated above, the knitting pattern indicating the unit pattern to be knitted may be inked in black on the column $11_1$ of the program carrier 1, and the scanner 2 scans the inked nitting pattern from side to side along each transverse row. Thus, the electric signals derived by the scanning operation draw a mode of the knitting pattern of the unit section at the transverse stage, or a rectangular wave is formed in accordance with the mode generated by scanning of the knitting pattern, as shown in FIG. 11[1]. This demonstrates that the electric signal obtained by the scanning has no one-to-one correspondence with the needle to be actuated and the function mark recorded on the columns $11_2$ and $11_3$ also may be read out by said scanner 2 as in the knitting pattern. Therefore, it is converted into an electric signal in the same electric system. However, one of two different electric signals is converted to a digital electric signal having one-to-one correspondence with the needle by a sampling pulse obtained during the scanning by the scanner 2 from a sampling pulse generator as will be described later, and the other is separated from the former.

A flat through-hole 12 is formed between the transverse holes $9_1$ and $9_1$ on the scanning member 8 of the scanner member 2, and a pulse plate 13 which is mounted in horizontal with said frame 6, between the guide bars $7_1$ and $7_2$, lies through the through-hole 12.

The fixed member 13 is provided at its rear end with slots $14_1$ for sampling the electric signal obtained by scanning the program carrier so that each of the slots 14, corresponds to one unit section in the transverse row of the column $11_1$ and is provided at its front end with three slots $14_3$ for sampling said signal such that the slots $14_3$ correspond to the three subcolumns of the column $11_3$ except for said rightmost subcolumn thereof.

On the scanning member 8 of the scanner 2, there are provided a sampling pulse generator $a_1$ adapted to produce predetermined pulses for sampling the electric signal obtained by scanning the program carrier through optically reading out the slot $14_1$, at the rear end of the fixed member 13 during scanning movement, and a sampling pulse generator $a_2$, adapted to produce a sampling pulse for sampling the function mark by optically reading out the slots $14_3$, at the front end thereof as well (FIG. 2).

Above and under the through-hole 12 passing through the fixed member 13, luminous elements, $15_1$ and $15_2$, and light sensitive elements, $16_1$ and $16_2$, are provided oppositely to each other at the position corresponding to the rear slots $14_1$ and the front slots, $14_3$.

However, the sampling pulse generator $a_1$ (more particularly the light-sensitive element $16_1$ constituting said pulse generator $a_1$), serves to output one pulse each time when the scanner 2 scans the unit section in the column $11_1$ of the program carrier 1, as illustrated in FIG. 11[$II_1$], while the sampling pulse generator $a_2$ may be adapted to output one pulse each time when the scanner 2 scans the three sub-columns of the column $11_3$, as illustrated in FIG. 11[$II_2$].

Automatic incremental feeding of the program carrier 1, will be described below:

Switch members, **17*l* and 17*r*, are mounted at both ends of said frame 6, and when the left switch member 17*l* is actuated by a left depression plate 18*l* on the scanning member 8 and the right switch member 17*r* is actuated by a right depression plate 18*r*, an electromagnetic device (not shown) mounted in the control box B urges the support 5** to rotate by one increment.

A ferromagnetic member 19 is provided at the front portion (carriage side) of the scanning member 8 and the front head of said ferromagnetic member 19 is slidably engaged in guide slot 20' provided in a power supply wall 20 extending over almost at a full length behind the needle bed of the machine body X, and the front of said head is exposed to the front face of the power supply wall 20. On the other hand, on the carriage Y, magnet 22 is mounted and provided with magnetic plates $23_1$ and $23_2$, which are mounted on its upper and lower surface at a position flush with the magnet 22 in the center of a casing 21 made of non-magnetic material which is mounted in the rear side of the carriage.

If the ferromagnetic member 19 is caused to attract the magnetic plates $23_1$ and $23_2$ during the running of the carriage Y, the scanner 2 starts to run together with the carriage Y. The scanning is completed by releasing the contact segment 19 from attraction of the magnetic plates $23_1$ and $23_2$ when it reaches the left or the right ends of the guide slot 20'. This indicates that the scanner 2 will travel along with the carriage left to right or vice versa only between the guide slots 20', irrelevant of the carriage travelling outside of the limited range. Thus, the knitting pattern on the program carrier 1 is read out as a digital electric signal, one member of which is equivalent to the unit section of the column $11_1$, as illustrated in FIG. 11[III]. This digital electric signal is stored in the storage MEM (see FIG. 10 of which details will be described later independently). Thus, the digital electric signal stored is read out each time when the carriage travels left to right or vice versa activating either one of the two needle selecting mechanisms, Cl and Cr, installed in both end sides of the carriage, which is responsive to the running time of the carriage Y. Therefore, one active needle selecting mechanism, Cl or Cr, for effecting the selective operation is controlled by said digital electric signal in accordance with the number contents (1 or 0). With respect to the timing pulse generating mechanism, it will be explained at below referring to FIGS. 4 thru 7.

The current collector means D carries magnet 25 and non-magnetic segment 26 both of which are sandwiched together between two upper and lower metallic plate $24_1$ and $24_2$ of a ferromagnetic and conductive material, respectively, and is generally formed as a single elongated strip by mounting a reflective plate 27 over the full length of the back surface of the magnet 25 and non-magnetic segment 26 between the metallic plates $24_1$ and $24_2$, and is slidably mounted in the elongated sleeve 21' of said casing 21 provided on the carriage Y, in a pre-determined range, and the back face thereof (FIG. 7) is exposed to the opening of the back face of the sleeve 21'.

The exposed face (back face) of said reflective plate 27 is light-sensitive and a plurality of rectangular holes 27' forming a non-reflective face are provided over the full length of the exposed face with the same spacing as a pitch of the needles 28 arranged on the needle bed *x*.

On the other hand, on the power supply wall 20, a plurality of timing pulse generators 29 (that is a combination of the luminous element and light-sensitive element) are arranged with a spacing shorter than the length of the reflective plate 27, for obtaining a timing pulse responsive to the running time of the carriage Y by irradiating the light against the reflective plate 27 and detecting the light reflected from the latter.

Is is understood that at least one of the timing pulse generators 29 is necessarily opposed to the reflective plate 27, which is moved during the movement of the carriage Y. Therefor, timing pulses are fed out from the timing pulse generators 29 as illustrated in FIG. 11[V] each time the carriage Y is shifted by one increment of the needle.

The timing pulse generators 29, which produce the timing pulses alternately at each running turn along the pre-determined length of the carriage Y, are connected to a single output system. The timing pulses would be sequentially fed out from the pulse generators regardless of the setting position of the carriage Y as if the timing pulses were supplied from the same timing pulse generator.

In the embodiment shown, during a carriage travel in either direction the storage MEM must read out therefrom the signals to be applied to the needle selecting mechanisms and simultaneously store the signals which are read out of the program carrier by the scanner 2. Accordingly, the storage consists of a pair of storage units which operate in response to the moving direction of the carriage in a manner in which during a carriage travel in one direction one storage unit stores while the other storage unit reads out, and during a carriage travel in the other direction the latter storage unit stores while the former reads out.

A mechanism for detecting the running direction of the carriage Y is provided in the machine along the running direction of the carriage in order to store the digital electric signals into the storage MEM and reading out the signals therefrom.

As described above, the upper and lower metallic plates $24_1$ and $24_2$ of the current collector means D always have a magnetic force, and projections $24_1$, and $24_2$, provided at multiple positions of the rear end thereof, normally attracted to a conductive and magnetic elongated plate 30, attached to the full front surface of the power supply wall 20 through a dielectric material.

As stated previously, the current collector assembly D is engaged with the sleeve 21' of the casing 21 to allow free sliding movement of same within the predetermined range limit. After the current collector assembly D is permitted to slide to the most right position of the casing 21, same is shifted by following the leftward running of the carriage Y while similarly, after the current collector assembly D is slid to the most left position reversely, same is shifted by following the rightward running of the carriage Y.

That is, the current collector assembly D is reversed to the right or left relative to the casing 21 in accordance with reversion of the running direction of the carriage Y.

Figure 7:
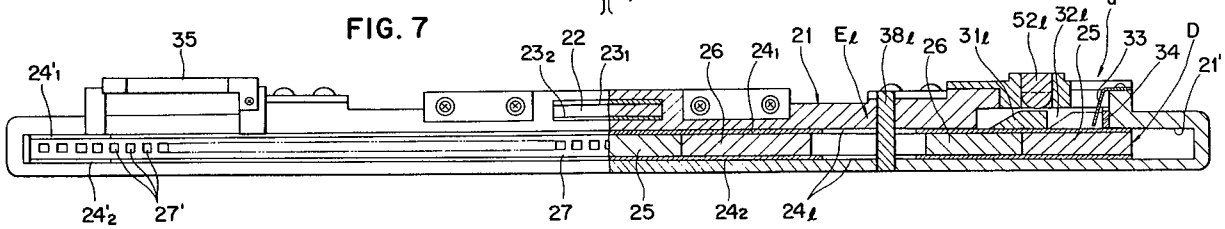
FIG. 7 is a sectional view of FIG. 6 taken along the line VII—VII.
Figure 8:
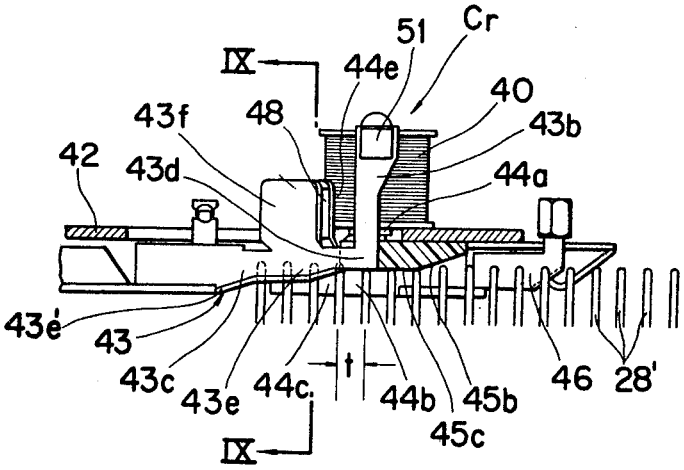
FIG. 8 is a sectional view of FIG. 6 taken along the line VIII—VIII.

As illustrated in detail in FIG. 7, a die 31*l* is attached to the upper left facing of the current collector assembly D and a resilient switch 33 and a terminal 34 are provided at the inside of a cavity 32*l* where the die 31*l* is received in the casing 21. If the carriage Y moves to the left, the die 31*l* disengages from the switch 33 which, in time, parts from the terminal 34 due to the current collector assembly D being biassed to the right to lead same into an electrical non-conductive condition, while if the carriage Y is shifted to the right, the switch 33 comes in contact with the terminal 34 due to the current collector assembly D being biassed to the left to lead same into an electrical conductive condition.

The terminal 34 is connected to a carriage panel 42 which also functions as a ground plate. To wit, the carriage panel 42 is electrically connected by way of the needle bed *x*, a pipe provided along the needle bed *x*, a rail inserted into the pipe to guide the carriage Y along the needle bed *x* to the negative pole of a direct current source, which is provided on the main body X, such as a transformer, a rectifier and a smoothing condenser combined to obtain a direct current power source from a commercially available alternate current.

Figure 5:
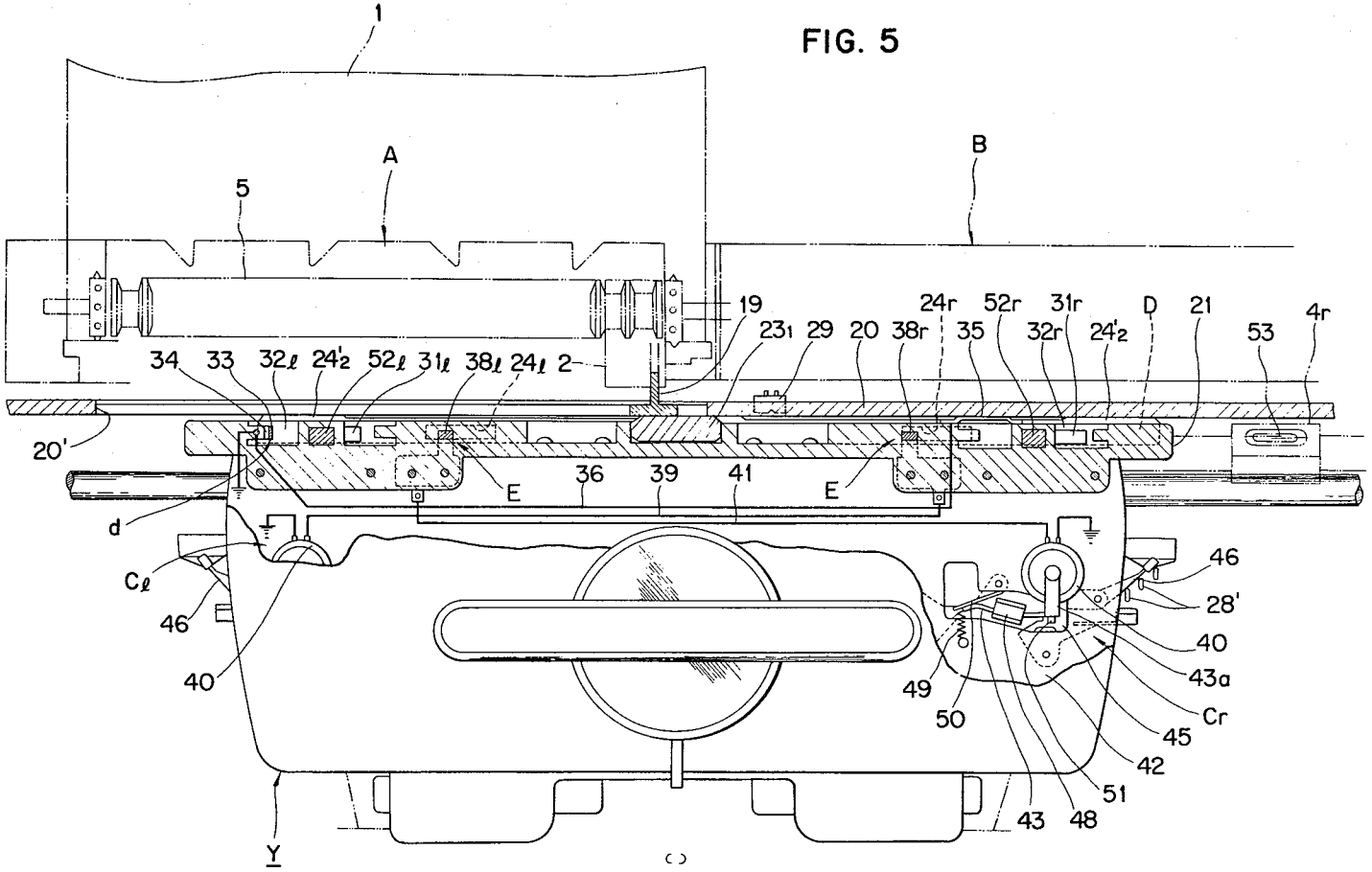
FIG. 5 is a plan view of the carriage partially cut away.

Therefore, the switch 33 and terminal 34 function as a limit switch and accordingly, constitute a detector means *d* for detecting the current moving direction of the carriage. As illustrated in FIG. 5, the switch 33 and terminal 34 are electrically connected to a contact segment 35, which is mounted at the right portion of the back surface of the casing 21, by way of a lead means 36. Due to the fact that the contact segment 35 maintains contact with a conductive plate 37 (see FIGS. 2 and 4) which is mounted over the full length of the front face of the conductive wall 20, it is understood that the detector means *d* is electrically connected to electric and electronic circuit elements which are accommodated in the control box B of the machine body. As illustrated in FIG. 11[VI], a two-value electric signal is fed out and changed from a high level to a low level signal and vice versa by changing the running direction of the carriage Y.

Thus, the temporary storage MEM is controlled by the two-value electric signal and storing and reading-out of the digital electric signal to and from the storage is effected in accordance with the running direction of the carriage Y. However, the digital electric signal read out from the storage is to be transmitted to one of the pair of needle selecting mechanisms Cl and Cr.

Figure 6:
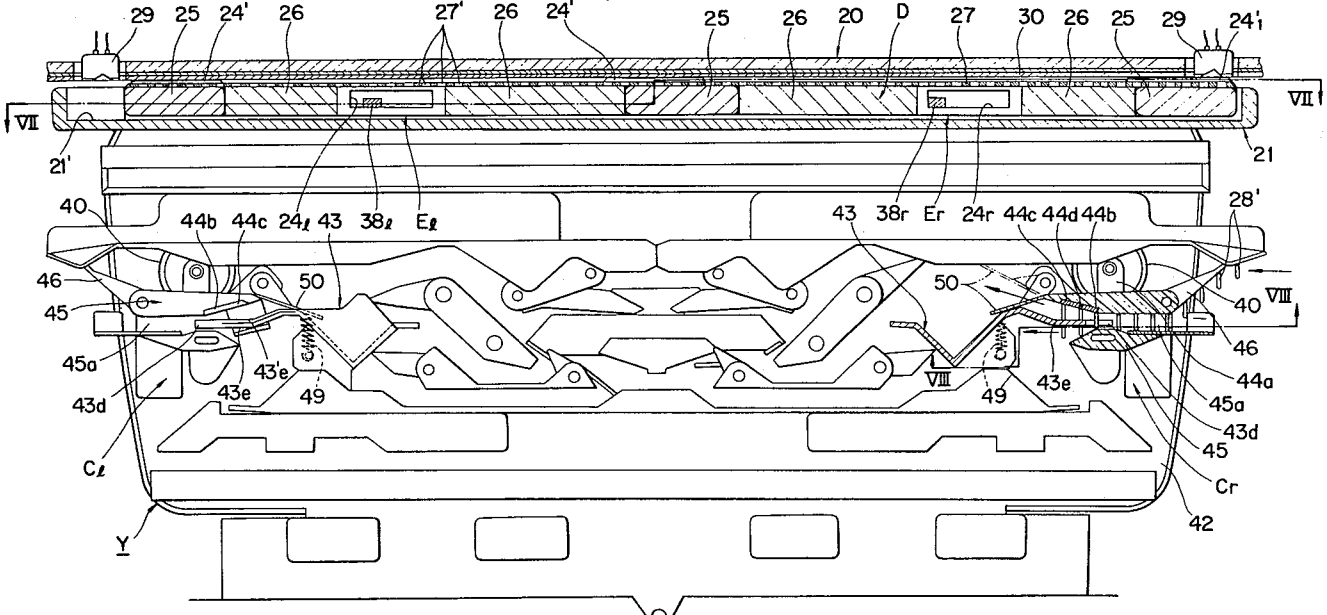
FIG. 6 is a bottom view of the carriage partially cut-away.

Referring, then, to FIGS. 5 through 7, description will be given as to a switch mechanism for alternately applying the read out digital electric signal to the needle selecting mechanisms Cl and Cr in accordance with the running direction of the carriage Y.

As described above, the upper and lower metallic plates $24_1$ and $24_2$ of the current collector means D are of conductive and magnetic material and they normally contact the conductive band 30 of conductive material which is provided in the machine body X so that power can be supplied from the machine body X.

The metallic plates $24_1$ and $24_2$, are provided, with holes 24*l* and 24*r*, respectively, each having a predetermined length. Conductive pieces 38*l* and 38*r* provided in the casing 21, pass through the holes 24*l* and 24*r*.

When the current collector means D is biassed to the right by the leftward running of the carriage Y, only the right conductive piece 38*r* electrically connected to the conducting band 30 of the machine body X through its contact with the left edge of the right hole 24*r*. Similarly, only the left conductive piece 38*l* is electrically connected to the conductive plate 30 by the rightward running of the carriage Y.

As illustrated in FIG. 5, the right conductive piece 38*r* is normally electrically connected to an electromagnet 40 of the left needle selecting mechanism Cl by a lead means 39, while the left conductive piece 38*l* is normally electrically connected to an electro-magnet 40 of the right needle selecting mechanism Cr by a lead means 41. One end of each electromagnet 40 is connected to a carriage base plate 42 functioning as a grounding plate.

The digital electric signal from the machine body X is transmitted to the electro-magnet 40 of the left needle selecting mechanism Cl through the right conductive piece 38*r* when the carriage Y is moved leftward, while same is transmitted to the electro-magnet 40 of the left needle selecting mechanism Cr through the left conductive piece $38_1$ when the carriage is moved rightward. Accordingly, it is to be understood that the conductive pieces 38*l* and 38*r* and the holes 24*l* and 24*r* constitute the left and right switch means El and Er for alternate supply of the digital electric signal.

Next, referring to FIGS. 4, 5, 6, 8 and 9, the left and right needle selecting mechanisms Cl and Cr will be described below. Arrangement of the components of the right and left mechanisms is symmetrical.

The electromagnet 40 is mounted on the carriage base plate 42. Horizontal portions 43*a* and 44*a* of the ferromagnetic conductors 43 and 44 are mounted on the top and bottom of the electro-magnet 40, respectively, and different magnetic poles are generated at the ferromagnetic conductors 43 and 44 as a result of the excitation of the electromagnet 40.

On the other hand, a butt guide 45 made of non-magnetic material is attached to the under surface of the carriage base plate 42.

A butt passage 45*a* is formed under the butt guide 45 as depicted in FIG. 4 and the butts 28' of the needles 28 can be received into the butt passage 45*a* through a side cam 46.

The width of the butt passage 45*a* is almost equal to that of the butt 28'. As understood from FIG. 8, the upper wall face of the butt passage 45*a* lowers gradually inwardly at an outer half 45*b* and maintains a constant level at an inner half 45*c* slightly lower than the normal position of the butt 28' (FIG. 4).

Accordingly, while passing through the butt passage 45*a* below the outer half 45*b*, the butt 28' is gradually depressed in opposition to a plate spring 47 shown in FIG. 4, until the butt 28' reaches the inner half 45*c*. Thereafter, the butt 28' proceeds with its top maintaining the level slightly lower than the normal position thereof until the butt 28' is released back to normal position by operation of the plate spring 47.

The magnetic conductor 43 allows the outer bottom 43*d* of vertical extension 43*c* extending to the lower side of the carriage base plate 42 to be inserted into the butt guide 45 and the flat bottom face of the outer lower portion 43*d* thereof is flush with the inner half of the upper wall of the butt passage 45*a* and is disposed in almost the center of the butt passage 45*a*.

Figure 9:
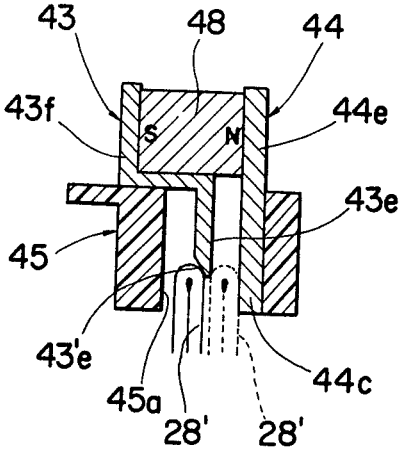
FIG. 9 is a sectional view of FIG. 8 taken along line IX—IX.

The lower edge of the central bottom portion 43*e* extending to the inside from the outer lower portion 43*d* and formed as a part of the vertical extension 43*c* is gradually inclined inwardly and at the same time, the front of the lower edge thereof is bevelled as illustrated in FIG. 9.

The other ferromagnetic conductor 44 is constructed such that through hole 44 is provided between the outer half 44*b* and the inner half 44*c* of the vertical portion extending from the front edge of its horizontal portion 44*a*. Accordingly, the magnetism from the electromagnet 40 exerts its force to the upper half 44*b*, but not to the inner half 44*c*.

The outer half 44*b* adapted to be magnetized has the same length as the distance between two adjacent needle butts and is positioned behind the outer bottom portion 43*d* of the ferromagnetic conductor 43, extending vertically to the position lower than the level of the lower edge of the outer bottom portion 43*d*.

However, selection of the needles which permits the butt 28' to be inserted into the butt passage 45*a*, is effected as described below.

The butt 28', guided through the butt passage 45*a* as a result of carriage movent, is gradually depressed in opposition to the urging of the spring 47 with its forward and backward movement prevented, and proceeds, with its top portion kept in contact with the lower face of the outer bottom portion 43*d* of the ferromagnetic conductor 43, until the butt 28' reaches the outer half 44*b* of the ferromagnetic conductor 44.

If the electromagnet 40 is excited while the butt 28' moves along the outer half 44*b* having the distance *t*, a magnetic circuit is formed between the ferromagnetic conductors 43 and 44 by way of the butt 28'. As result, the butt 28' is guided backward along the outer half 44*b*.

As illustrated in detail in FIG. 9, the butt 28' biassed backward is attracted to the inner half 44*c*, as shown by a dotted line in FIG. 9, since a magnet piece 48 is provided between the portion 44*e* of the inner half 44*c* (not excited by the electromagnet 40) of the ferromagnetic conductor 44 and the portion 43*f* of the ferromagnetic conductor 44. The butt 28' regains its original height due to the urging of the spring 47 behind the central bottom portion 43*e* of the ferromagnetic conductor 43 and further proceeds to push open a switch member normally closed by the urging of a spring 49, thus taking the rear course.

On the other hand, when the electromagnet 40 is excited, the butt 28' proceeds on a straight course because it is not attracted by the inner half 44*b* of the ferromagnetic conductor 44. In this way, the butt 28' proceeds on the front side of the ferromagnetic conductor 43 by being introduced to the bevel 43'*e* as shown by a full line, and proceeds through the front guide passage after passing a point 44*d'*.

On the vertical portion 43*b* of the ferromagnetic conductor 43, a buffer magnet piece 51 is mounted so that its magnetic pole is provided so as to eliminate residual magnetism created by the electromagnet 40. In this way, it is possible to carry out the selecting operation more effectively by eliminating the residual magnetism still existing in the electromagnet 40 or both ferromagnetic conductors 43 and 44 while the electromagnet is not excited.

It is noted that the needle 28 entering the butt passage 45*a* is subjected to the selecting operation one by one as stated above, but if the needle 28 entering the butt passage 45*a* is positioned out of the limit range of the left and right boundary members 4*l* and 4*r*, the electromagnet 40 remains unexcited. In this way, the needles are not subjected to the selecting operation.

In the construction described above, a cavity 32r (FIG. 5) is provided at the right portion of the casing 21 while a left cavity 32l (FIG. 7) is provided at the left portion of same on the bottom of the carriage Y. The piece 31l at the left portion of the current collector means D and the piece 31r in the reversed position are provided the casing 21.

Above the upper wall of the left and right cavities $32_1$ and 32r in the casing 21 and substantially behind the needle selection effecting point (the width *t*) of the left and right needle selecting mechanism Cl and Cr, left and right movable magnet pieces 52l and 52r are provided for vertically sliding same along guide slots thereof, respectively. The movable magnet pieces 52l and 52r are actuated vertically by movement of the dice 31 and 31r, respectively. The left die 31 is raised and the right die 31r is lowered when the current collector means D is biassed at the right position while they are moved into a reverse direction when the latter is biassed at the left position.

On the other hand, each of the boundary members 4l and 4r, which are slidably mounted on the inclined portion of the top end of the power supply wall 20, is provided, on its bottom face, with a reed switch 53 and two separate contact segments 54 electrically connected to each read switch 53, respectively. The two separate contact segments 54 of each boundary member are arranged on the bottom face of the inclined portion of the power supply wall 20 in a parallel relation to each other. The two contact segments 54 of the boundary member 4r contact a left conductive leaf 55 and a center conductive leaf 55 when viewed in FIG. 4, respectively, while the two contact segments 54 of the boundary member 4l contact a left conductive leaf 55 and a right conductive leaf 55 also when viewed in FIG. 4. The contacts are kept by the resiliency of the contact segments. "ON" and "OFF" signals are separately provided to the reed switches 53 of the boundary members 4r and 4l, respectively.

The reed switches 53 are disposed above the movable magnet pieces 52l and 52r along the lines of their movement so that any one of the reed switches 53 can be operated by either of the movable magnet pieces 52l and 52r which is in a raised position.

Therefore, each of the reed switches 53 is turned on by the left magnet piece 52l during the leftward movement of the carriage and by the right magnet piece 52r during the rightward movement of the carriage. As a result, the boundary members 4l and 4r produce pulses as shown in FIG. 11 [VII] and [VIII]. (In the waveforms illustrated in this figure, obstructive noises such as chattering, are eliminated for obtaining a required waveform.) The above-mentioned pulses produced by the boundary members 4l and 4r indicate the initiation or termination of the needle selection by the needle selecting mechanisms Cl and Cr. In other words, signals are produced so that only the needles between the boundary members 4l and 4r carry out the needle selection operation. In this way, the boundary members 4l and 4r one adapted to indicate the left and right ends of a knitting pattern and defines a range in which needle selection is to be effective. As will be mentioned later, one of the pair of boundary members is adapted to constitute a reference means for selectively determining the reference needle for knitting. The boundary members 4l and 4r have an indicium 56 at their front to indicate "left" and "right," respectively, and provided with a pointer 57. Needle indication marks 58 are impressed on the inclined portion of the top of the power supply wall 20 in correspondence to the respective needles 28. The points 57 and needle indication marks 58 are adapted to indicate the exact boundary between a range in which needle selection is to be effected and a range in which needle selection is not effected. In this way, the needles 28 in a range defined by the pointer 57 provided on each of the boundary members 4l and 4r is subjected to needle selection by the needle selection mechanisms C*l* and C*r*. As a result, the knitted product has a pattern only on a portion when those selected needles are concerned.

Figure 10:
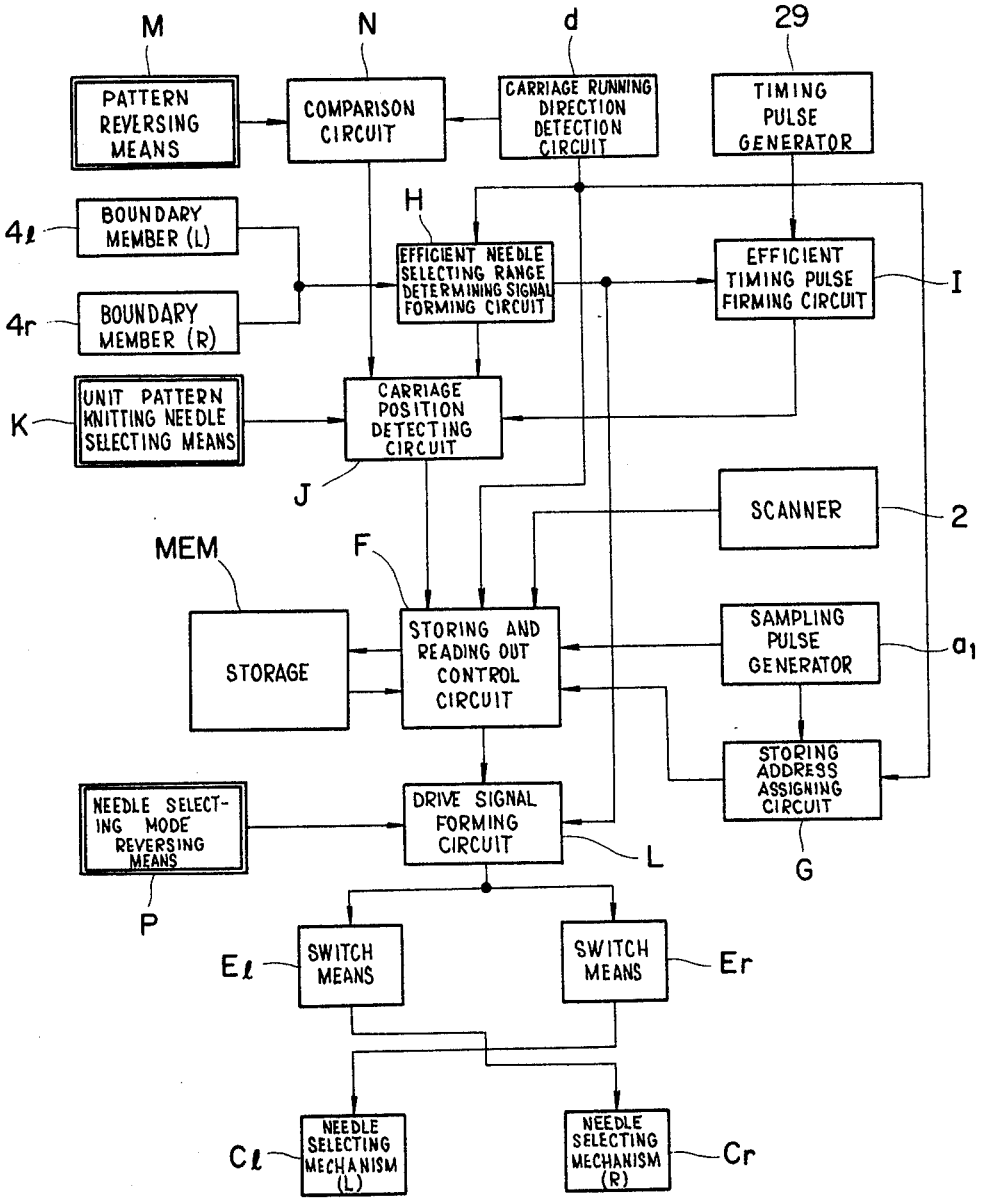
FIGS. 10 and 11 are a block diagram and a time chart, respectively, illustrating electric and electronic constructions.

The mechanical construction can be understood by the foregoing description. Referring next to FIGS. 10 and 11, the electric and electronic construction including control circuit means for the electromagnets will be stated below.

The two-value signal (FIG. 11[I]) from the scanning member 2 and the sampling pulse [$II_1$] from the sampling pulse generator $a_1$ are applied together to a recording and reading out control circuit F, wherein the signal [I] is converted to the digital electric signal as illustrated in [III] in the control circuit by sampling it. The digital electric signal is stored in a predetermined address of the storage MEM relative to the scanning direction of the scanning member 2, that is, the running direction of the carriage Y under the control of the recording address assigning circuit G and the carriage running direction detecting means *d*.

That is, the recording address assigning circuit G includes an up-down counter for counting the sampling pulses from the sampling pulse generator $a_1$. The output signal [VI] from the carriage running direction detecting means *d* is adapted to effect switching of the counting operation in accordance with the running direction of the scanner 2, and the digital electric signal, with 60 numbers for one stage scanning of the column $11_1$ on the program carrier 1, namely for scanning all the unit sections (in this example, 60 numbers) in the row is separately stored into the predetermined address in the storage MEM for the left and right runnings of the scanner 2. [I] to [IV] to FIG. 11 are time charts showing the storing operation into the temporary storage MEM and [V] to [XVII] in FIG. 11 are time charts showing the reading-out operation from the temporary storage MEM.

Reading-out of the digital electric signal which has been stored in the memory will be described below.

The pulses [VII] and [VIII] from the boundary members 4l and 4r are applied to a signal forming circuit H including a flip-flop circuit for determining a needle selecting range, thereby the signal [IX) may be formed in accordance with the interval of the pulses from the boundary members 4l and 4r. This signal [IX] is applied to an efficient timing pulse forming circuit I comprising a gate circuit etc. whereby the timing pulses [X] equal to the set number minus one of the knitting needles 28 provided between the boundary member 4l and 4r are fed out one by one in correspondence to one pitch of the needle in each movement of the carriage Y.

The timing pulse [X] are applied to a carriage position detecting circuit J including an up-down counter, where adding or subtracting operation is effected in accordance with the running direction of the carriage Y.

The maximum counting value is optionally set by a setting means K for setting a unit pattern knitting needle number which functions as a setting value preset means (this manually operable member is mounted on the operation panel 3 of the control box B). Each time the timing pulse [X] is added or subtracted by as much as the setting number, as illustrated in FIG. 11 [XIII], the detecting circuit J takes the same value (parallel binary electric signal) repeatedly.

In other words, it is considered that the carriage position detecting circuit J addresses, in a given direction repeatedly, the needles 28 provided between the boundary members 4*l* and 4*r*.

The starting point of the adding or subtracting, to wit, the reference needle for knitting, is decided by either one of the boundary members 4*l* and 4*r* (usually by the boundary member 4*l*). In other words, the leftmost knitting needle among the needles 28 in a range in which needle selection is to be effective, to wit, the needle indicated by the pointer 57 of the left boundary member 4*l*, is selected as the reference needle for knitting. In this way, this specific needle 28 always knits the contents of column 1 (left end) of the program carrier.

The output of the detecting circuit J is applied to the storing and reading-out circuit F as a reading-out address signal for the storage MEM only during output of the efficient needle selecting range determining signal [IX]. The stored digital electric signal having 12 numbers from 0 to 11 is repeatedly read out. After the signal is fed out from the storing and reading out control circuit F in the form of the signal as illustrated in FIG. 11 [XV], same is applied to a drive signal forming circuit L including an "AND" circuit to which the efficient needle selecting range determining signal IX is applied, and fed out to the electromagnet 40 of the needle selecting mechanism Cl or Cr which effects the efficient selecting operation by the switch means El or Er as the two-value electric signal during output of the signal [IX].

Thus, as illustrated in FIG. 11 [XIV], the needles 28 provided between the boundary members 4*l* and 4*r* may be selected in one group consisting of 12 needles, in accordance with the configuration of the knitting pattern drawn between the minimum section at the left end of the column $11_1$ and the minimum section at the right by as many as 11 sections therefrom.

As is apparent from the foregoing description, the column $11_1$ on the program carrier 1 is scanned from side to side and all the numbers of the digital electric signal obtained through the scanning are stored in the storage MEM. Thus, the number to be read out is determined by the setting means K for setting the unit pattern needle number. For example, when the number is set at 12, if recording is effected from the left end on the column $11_1$ to the right end of same and once stored in the storage MEM through the scanning operation, the recorded information is not read out as a signal for effecting the needle selecting operation. As described above, the unit pattern knitting operation can be effected, in the afore-mentioned construction, corresponding to the knitting pattern on the program carrier 1. The machine has such a further construction that the configuration of the pattern to be actually knitted can be changed by operation of operative members provided on the control panel 3 without changing the knitting pattern, which will be described below.

A pattern reversing means M from the right to the left and vice versa is so provided that the output electric signal can be reversed as illustrated in FIG. 11 [XI] by switching the operation of a manually operable member from high level to low level and vice versa. The signal [XI] is compared with the output [VI] of the carriage running direction detecting means *d* in a comparison circuit N (wherein an exclusive logical sum is carried out) so that the adding and subtracting direction of the up-down counter in the carriage position detecting circuit J may be determined by the comparison signal [XII].

Thus, knitting patterns having profiles reversed to each other can be obtained from a single needle selection program recorded on the program carrier 1 by reversing the adding and subtracting direction in the above switching operation.

In this case, the above-mentioned reference needle is also changed by the above switching operation. In other words, the rightmost needle out of the knitting needles 28 within a range in which needle selection is to be effective, to wit, the specific knitting needle 28 indicated by the pointer 57 of the right boundary member 4*r*, will be selected as the reference needle to be used for knitting and will always knit the contents of column 1 (left end) of the program carrier 1.

However, the counting value of the carriage position detecting circuit J is determined by the operation of the pattern reversing means M, in other words, according to either signal [XIII] or [XVII] obtained in accordance with the running direction of the carriage Y. Therefore, even if the knitting pattern on the program carrier 1 is identical, the pattern to be knitted can be reversed.

Next, a needle selecting mode reversing means P puts out the electric signal similar to that of the pattern reversing means M by the switching operation of the manually operable member. The electric signal is applied to the drive signal forming circuit L and the output from the drive signal forming circuit L takes the form of the signal [XVI] or the reversed form of said according to the operation of the means P.

Accordingly, the mode of selecting the needles 28 can be reversed by the means P whereby the ground pattern of the pattern to be knitted can be changed without changing the knitting pattern on the program carrier 1.

So far, the storing into the storage MEM of the signal is effected with respect to the digital electric signal containing all the bits concerned with the scanning along one whole stage and only the signal with a limited number set in the reading-out operation is taken out to effect the unit pattern knitting operation. However, such storing operation can be effected with respect to only the signal with the set numbers. In this case, all of the stored signals are read out with the same result.

Having above discussed the inventive circuitry and its operation in connection with FIGS. 10 and 11, attention is directed to FIGS. 12–15 presenting the circuitry in schematic form.

Figure 12:
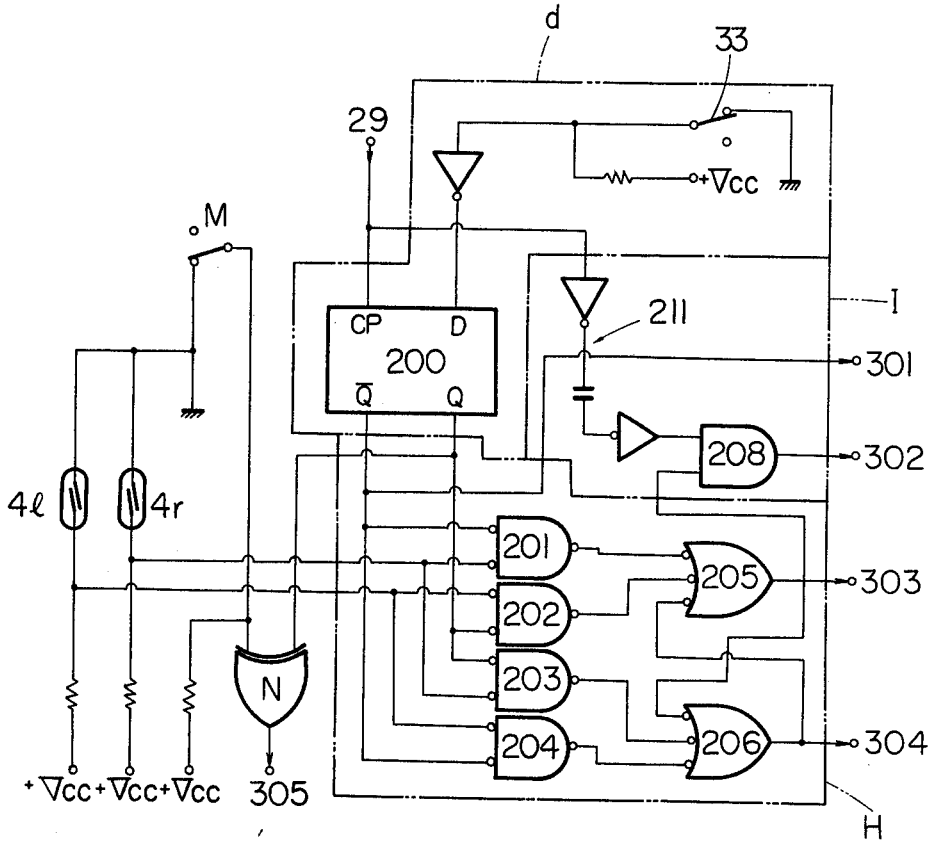
FIGS. 12-15 are circuit diagrams for a preferred embodiment of the invention.
Figure 13:
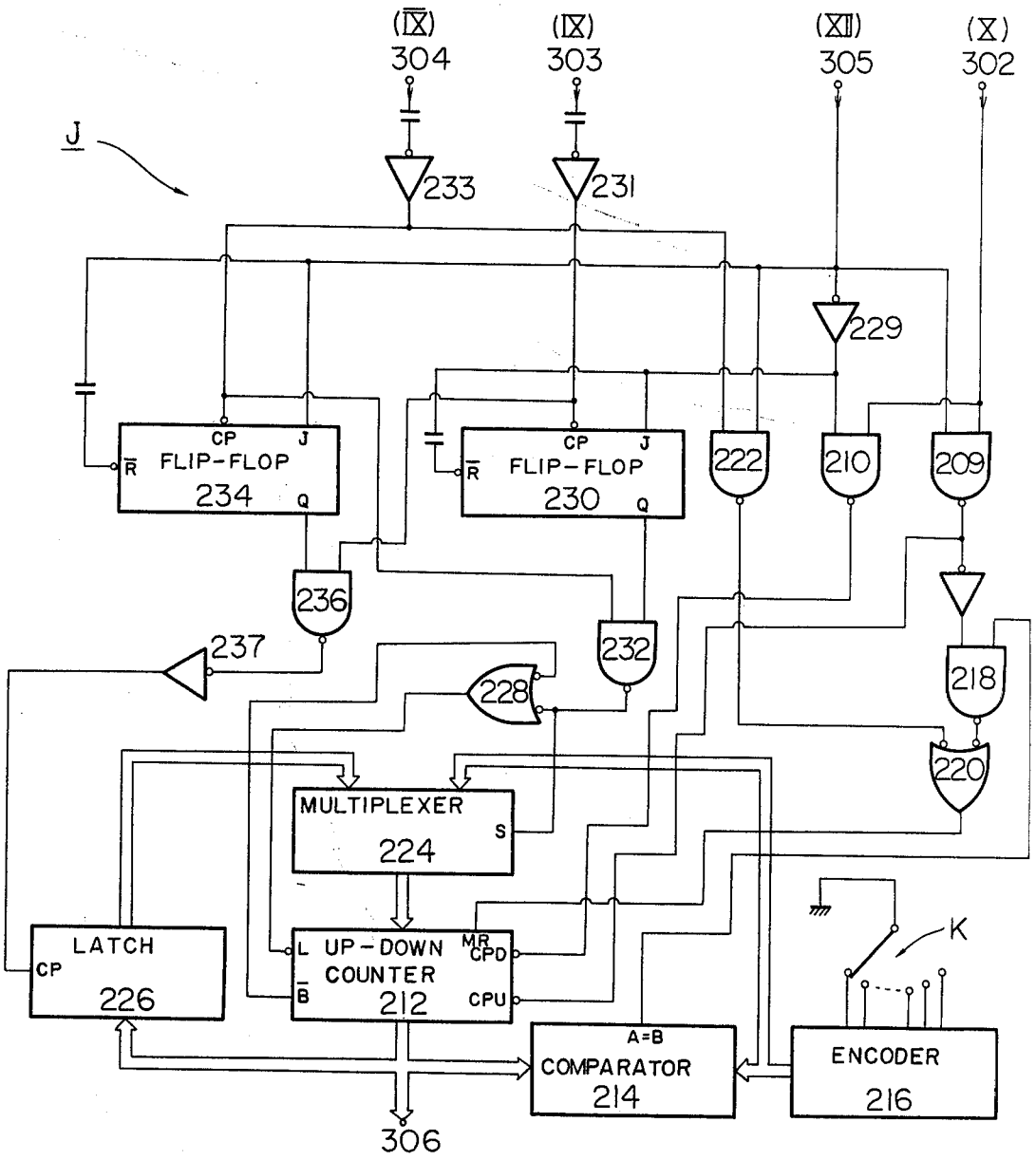
Figure 14:
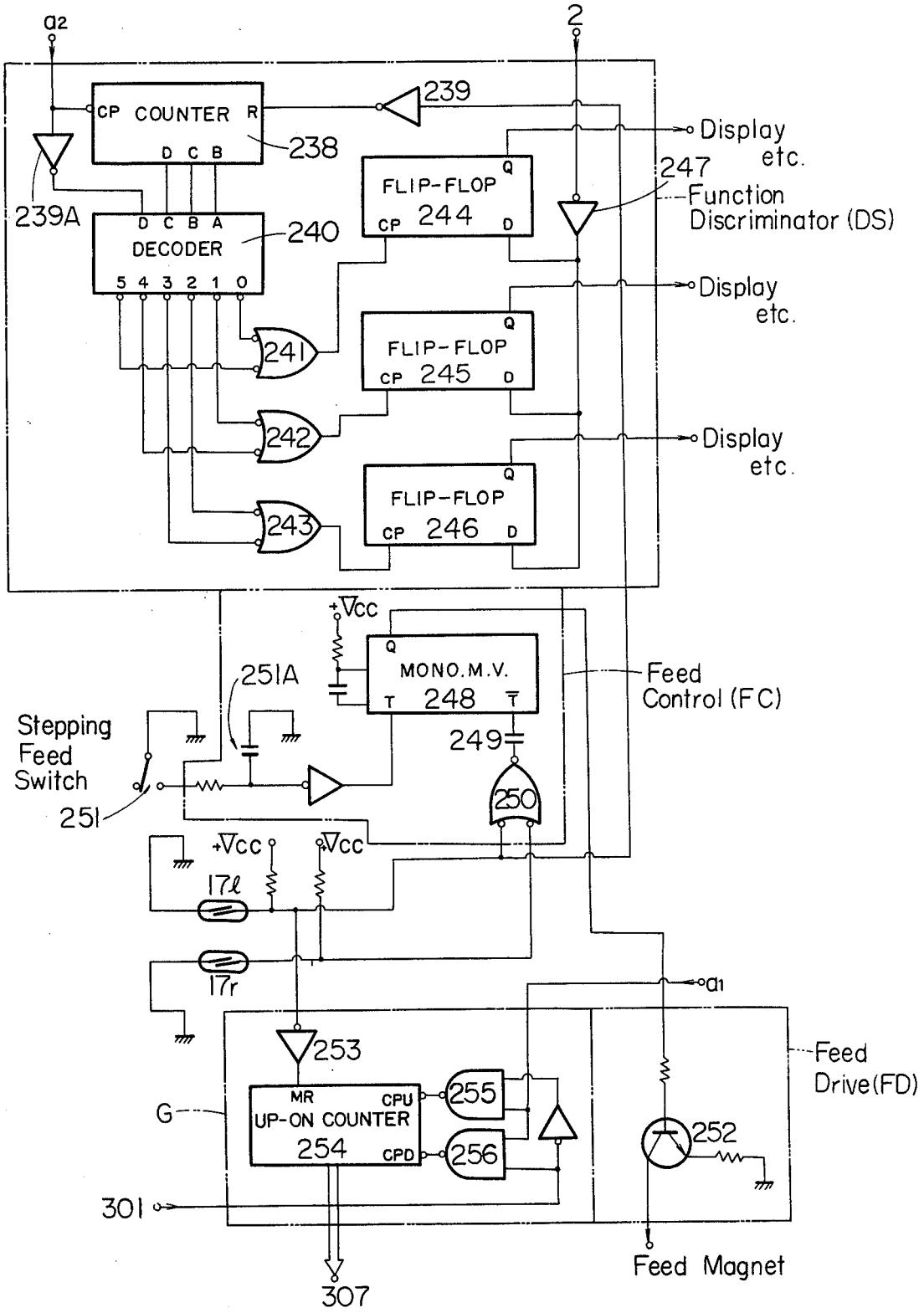

For convenience, attention is first directed to the circuitry for reading out of the digital electric signal which has already been stored in the memory, as same is disclosed in FIGS. 12, 13 and portion of FIG. 14.

As above discussed, the efficient needle selecting range determining signal forming circuit H may comprise a flip-flop circuit (particularly an RS flip-flop). As shown in FIG. 12, the circuit H comprises negated input NAND gates 201–204 driving cross-connected negated input OR gates (NAND function gates) 205 and 206, having respective outputs at 303 and 304. The output 303 of gate 205 may be considered the terminal Q of the flip-flop circuit H and provides the signal IX of FIG. 11. As indicated by FIG. 10, the input gates of flip-flop circuit H receive pulses from the boundary member switches 4*l* and 4*r* (here each connected between ground and a resistor connected to a positive voltage supply) and the waveform from the carriage running direction detecting means *d*. In the particular embodiment shown in FIG. 12, the outputs of boundary member switches 4*l* and 4*r* correspond to, but are reversed in polarity from, the signals [VII] and [VIII] in FIG. 11, respectively.

In the embodiment shown in FIG. 12, such carriage direction detecting means *d* includes not only the mentioned switch 33 (FIG. 7), but also a D flip-flop 200 having outputs Q, $\overline{Q}$. The output at terminal Q of flip-flop 200 is substantially that of the carriage running direction detection circuit d shown at VI in FIG. 11. As shown, the Q and $\overline{Q}$ outputs of carriage direction circuit d drive input gates 201–204 of needle selecting range circuit H. The D input of lip-flop 200 is connected to output of an inverter, the input of which has a level dependent on the moving direction of the carriage, being alternatively shunted to ground through closure of switch 33 or, with such switch open, held at a higher voltage level through the resistor connecting it to the positive voltage supply V*cc*. The input at D is clocked into flip-flop 200 by connection of its clock terminal C*p* to the timing pulse generator 29 which supplies timing pulses responsive to the running time of the carriage Y.

As mentioned, the efficient time pulse forming circuit I comprises a gate circuit, namely AND gate 208 (FIG. 12), which is supplied timing pulses from generator 29 through the series pair of inverters and capacitor generally indicated at 211 for gating therethrough the output at 303 of range determining signal circuit H. In the particular embodiment shown in FIG. 12, the output of AND gate 208 corresponds to, but is reversed in polarity from, the signal at X in FIG. 11.

The manually operable pattern reversing means is shown in FIG. 12 as a manually openable and closeable switch M connected between ground and (through a dropping resistor) to the positive potential supply V*cc*. The comparison circuit N, which as mentioned is to carry out an exclusive logical sum, conveniently in FIG. 12 takes the form of a single EXCLUSIVE OR gate N having one input connected to the higher voltage side of pattern reversing switch M and its other input connected to the Q output of the carriage running direction detection circuit d, as in FIG. 10. The EXCLUSIVE OR gate N provides an output as shown at XII in FIG. 11.

The carriage position detecting circuit J (FIG. 13) includes, as mentioned, an up-down counter at 212. The counter 212 is in the preferred embodiment a synchronous up-down eight-bit binary counter, having separate up and down clock inputs, parallel load facility, terminal count outputs for multi-decade operation, and a synchronous overriding master reset. The counter 212 may be implemented by suitable connection of two Fairchild TTL/MSI 74193 chips. As seen in FIG. 13, counter 212 has its countdown clock pulse input at CpD, its countup clock pulse input at CpU, its master reset (clear) input at MR, its parallel load (active low) input at L and its terminal countdown (borrow) output at B. Parallel data are loadable into up-down counter 212 from the parallel outputs of a multiplexer 224. The parallel outputs of counter 212 are indicated at 306 and are the outputs of the carriage position detecting circuit J (see FIG. 11 at XIII).

The multiplexer 224 preferably is an octa 2-input digital multiplexer circuit consisting of eight multiplexing circuits with common select(s) input, each such multiplexing circuit having two inputs and one output, for two sets of eight parallel inputs each and an eight-position parallel output, which connects to the parallel inputs of the up-down counter 212. The multiplexer 224 may be implemented, for example by suitable connection of two Fairchild TTL/MSI 9322 chips.

The mentioned setting means K for setting the maximum counting value is shown in FIG. 13 as a manually actuable multiple switch actuable to ground the alternatively selected one of its several poles, the latter being connected to the paralel inputs of an encoder 216. The latter is preferably a diode matrix encoder having an eight bit parallel output connection to one side of a comparator 214.

The comparator 214 is preferably an eight bit comparator which provides comparison between the eight bit word read out of the encoder 216 and the eight bit word read at 306 out of the up-down counter 212, the comparator providing an output "equal to". For example, the comparator 214 may comprise two suitable connected Fairchild TTL/MSI 9324 chips. When the count in counter 212 equals the encoded setting of switch K, the comparator 214 provides an output (at its output terminal indicated at A=B) to one input of a NAND gate 218.

Given such a comparison output, in coincidence with movement of the carriage in the proper direction as indicated by output 305 of comparison circuit N, location in the aforementioned needle selecting range as indicated by outputs 303 and 304 of needle selecting range circuit H, and a clock pulse on line 302 from the timing pulse forming circuit I, NAND gate 218 acts through negated input OR gate 220 to trigger the master reset (clear) input MR of the up-down counter 212.

More particularly, counter clear input MR is controlled by the output of negated input OR gate 220 having inputs respectively from the NAND gate 218 and from a further NAND gate 222 in turn having inputs from lines 305 and (through a capacitor and inverter) line 304. NAND gate 218, aside from its input connected to the comparator 214 output, has its remaining input fed through an inverter from a NAND gate 209, the inputs of which in turn are connected to aforementioned lines 302 and 305.

The countdown and countup clock pulse inputs of the counter 212 receive clock pulses alternatively depending on the direction of carriage movement. More particularly, the countup clock pulse input CpU is triggered by the output of aforementioned NAND gate 209 whose inputs connect to lines 305 and 302, respectively. On the other hand, the countdown clock pulse input CpD is controlled by the output of a NAND gate 210 whose inputs are connected similarly to those of NAND 209 but with the connection to line 305 being through an inventer such that gates 209 and 210 are enabled to transmit clock pulses from line 302 for opposite directions of movement of the carriage as represented by the output on line 305.

The carriage position detecting circuit J further includes, for downcount operation of the counter 212, dual JK flip-flops 230 and 234. The J inputs of the flip-flops are enabled, one with the carriage Y moving in one direction and the other with said carriage moving in the opposite direction. More particularly, the J input of flip-flop 234 connects direct to line 305, the carriage movement direction indicating line from EXCLUSIVE OR gate N. The J input of flip-flop 230 is similarly connected but through inverter 229. The end of the J enabling signal for each flip-flop is detected by a capacitor and applied to the clear input $\overline{R}$ of the same flip-flop, the clear inputs $\overline{R}$ of flip-flops 234 and 230 connecting each through their own capacitor to, respectively, aforementioned carriage direction line 305 and its extension through inverter 229. The flip-flops 230 and 234 are clocked by connection of their clock inputs Cp through a series inverter and capacitor 231 and a further series inverter and capacitor 233, respectively, to the needle selecting range output lines 203 and 304, respectively, from the true and inverted outputs of needle selecting range circuit H.

The flip-flop 230 is connected to control the select input of multiplexer 224 and the parallel load input L of the up-down counter 212, while flip-flop 234 is arranged to clock an eight bit bistable latch 226. As controlled by its select input S, the multiplexer applies either the eight bit parallel output of the encoder 216, or the eight bit parallel output of the latch 226, to the parallel inputs of the up-down counter 212. While, as mentioned, the encoder 216 provides a parallel binary reading of the setting of the manual switch K, the aforesaid latch 226, has parallel inputs which connect to the parallel outputs of up-down counter 212.

More particularly, with the carriage Y going in one direction, the Q output of flip-flop 234 enables a NAND gate 236 from the time of entry into the needle selection range established by circuit H, for the duration of carriage travel in such one direction. Intermediate in this time, at the end of such needle selection range, the other input of NAND 236 is pulsed from the path 231, 303, to provide a pulse through an inverter 237 to the clock input Cp of the latch 226 to clock thereinto the output of up-down counter 212.

On the other hand, the J input of flip-flop 230 is enabled from line 305 and inverter 229 during reversed carriage movement. The clock input Cp of flip-flop 230 is actuated, through inverter-capacitor set 231 and needle selecting range output 303 of circuit H, at the end of the needle selecting range so as then to actuate the output Q of flip-flop 230 which output remains actuated until the end of carriage movement in such reverse direction, i.e. until the waveform at 305 reverses, thus applying a pulse through the capacitor shown to the reset terminal $\overline{R}$ of flip-flop 230.

The NAND gate 232 is enabled by the resulting logic one at the output Q of flip-flop 230 and has its other input connected through the capacitor-inverter 233 to the line 304 of needle selecting range circuit H. The output of NAND 232 controls the select input S of multiplexer 224. Also, a negated input NOR gate 228 has its inputs connected to aforementioned NAND gate 232 and to the terminal countdown output $\overline{B}$ of counter 212, the output of gate 228 connecting to the parallel load input L of the counter 212.

In such arrangement of the carriage position detecting circuit J, circuit means including multiplexer 224, latch 226, flip-flop 234, NAND gate 236 and inverter 237 is preferably provided for allowing the co-existence of two separate needle selecting ranges, in other words, of two pairs of left and right boundary members on the needle bed. More particularly, where there are two separate needle selecting ranges defined, during a carriage travel in one direction flip-flop 234 enables the NAND gate 236 from the time of entry into the first needle selecting range until the time of entry into the second one whereby the output of up-down counter 212 is clocked into the latch 226 at the end of the first needle selecting range so that the counted value at that time is stored in said latch 226. During a subsequent carriage travel in the reversed direction, flip-flop 230 enables NAND gate 232 from the end of the second needle selecting range until that of the first one whereby, at the time of entry into the first needle selecting range, the other input of NAND 232 is pulsed from the path 233, 304 to provide a pulse to the select input of multiplexer 224 and through negated input NOR 228 to the parallel load input L of up-down counter 212 so that said value previously stored in the latch 226 is selected to be loaded into up-down counter 212 at that time of entry. Meanwhile, the counted value at the end of the second needle selecting range during carriage travel in said one direction is held until the time of entry into said second needle selecting range during subsequent carriage travel in said reversed direction.

On the other hand, where there is a single needle selecting range defined, NAND gate 232 is not at all enabled by flip-flop 230 during any carriage travel in said reversed direction so that the value, which was clocked into latch 226 during a previous carriage travel in the one direction, is not selected to be loaded into up-down counter 212. Accordingly, said circuit means including multiplexer 224 etc. is not effective where there is a single needle selecting range defined.

As stated, the output of the carriage position detecting circuit J, namely the parallel output on path 306 (seen at XIII in FIG. 11) is thus applied as a reading-out address signal from the storage MEM only during output of the efficient needle selecting range determining signal (IX in FIG. 11).

Figure 15:
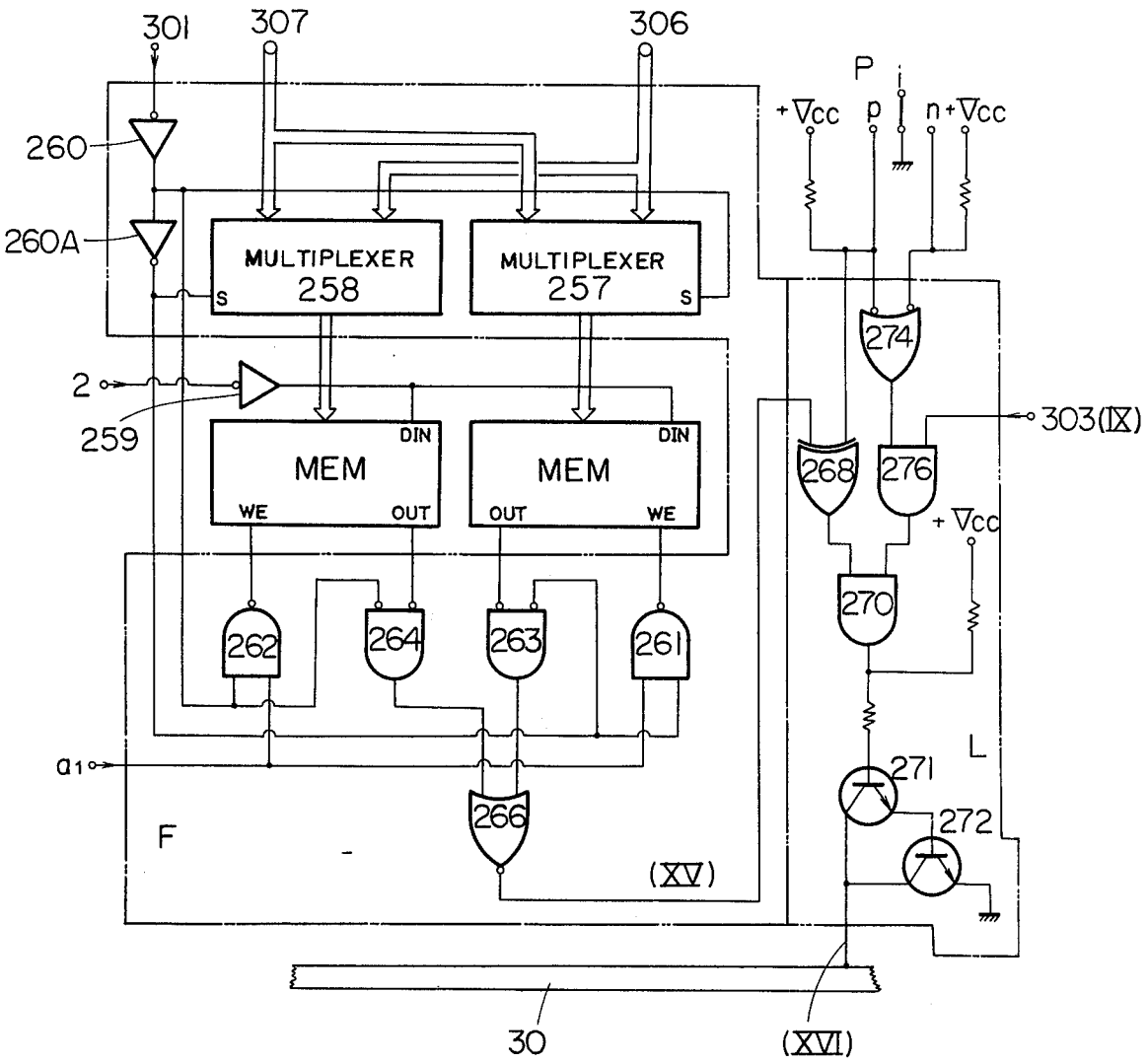

FIG. 15 discloses a preferred storing and reading-out circuit F connected to the storage MEM. In the preferred embodiment shown, two storage units MEM are provided, each being a 256 bit fully decoded random access memory. For example, each may be a Fairchild TTL Isoplanar Memory 93410. Each of storage units MEM has a data input DIN connected, here through an inverter 259, with the output of the scanning member 2 which reads the missing pattern from the program carrier 1 as above described. Each storage unit MEM also has a data output OUT and a write entry terminal WE. With the write entry terminal WE held low the storage unit MEM will store data from scanner 2, but with write entry terminal WE high, the storage unit MEM will read out data from its output terminal OUT.

As part of the recording and read-out control circuit F, there is provided a pair of octa two input digital multiplexer circuits 257 and 258, preferably similar to multiplexer 224 above described. Each multiplexer has a first eight bit parallel input set connected to parallel outputs 306 of the carriage position detecting circuit J, to receive addresses for reading out, controlled by carriage movement from circuit J. The second eight bit set of parallel inputs of the multiplexers 257, 258 connects to the parallel outputs 307, hereinafter described, of the recording address assigning circuit G, for receiving addresses for storing of data from such circuit G. The multiplexers 257, 258 are each alternatively fed from address paths 306 and 307 depending on the state of their respective select inputs S. Here the output of the carriage motion direction detector *d*, seen at VI in FIG. 11 and appearing on line 301, is applied through a first inverter 260 to the select input S of multiplexer 257 and same is also through a second inverter 260A applied to select input S of multiplexer 258. Thus, with carriage running in one direction, multiplexer 257 makes available to its storage unit MEM, in parallel, address data for reading out, while multiplexer 258 makes available, in parallel to its storage unit MEM address data for storing of knitting pattern data. With the carriage moving in the opposite direction, the roles of multiplexers 257 and 258 are interchanged. Thus, addresses for reading out are being supplied to one storage unit MEM while addresses for storing are being supplied to the other, and vice versa.

To control the operative state of each storage unit MEM (i.e. storing or reading out) the write entry terminals WE of the two storage units MEM are controlled by the outputs of respective NAND gates 261 and 262. Gates 261 and 262 have respective enabling inputs from inverters 260A and 260, with the remaining input of each such gate receives sample pulses from sample pulse generator $a_1$. In this way, one storage unit MEM stores data from scanning means 2 while the other reads out data from its output terminal OUT, depending on the direction of carriage movement.

The data terminals OUT of the storage units MEM connect through respective negated input AND gates 263 and 264 to a NOR gate 266, the remaining inputs of such gates 263 and 264 being connected to the carriage direction indicating outputs of inverters 260A and 260, respectively, such that output from a given storage unit MEM reaches the output gate 266 only with carriage moving in the corresponding direction. The data outputs from gate 266 constitute the output of recording and reading-out control circuit F (as at XV in FIG. 11) and passes as above mentioned to the drive signal forming circuit L of FIG. 15.

The drive signal forming circuit L here comprises an EXCLUSIVE OR gate 268. The drive signal forming circuit L is also controlled by the needle selecting mode reversing means P.

The latter comprises a single pole switch having three positions, namely a positive mode position *p*, a negative mode position *n* and an inoperative mode position *i*. Usually the first position *p* is selected but when needle selection mode reversal is desired, the second position *n* is selected. When needle selection is temporarily unnecessary, the third postion *i* is selected so that no design is obtained. As seen in FIG. 15, selection of either the *p* or *n* switch positions applies a low (ground) potential to the corresponding input of negated input OR gate 274. Accordingly, with either the *p* or *n* position of switch P selected, gate 274 applies a high to the corresponding input of AND gate 276. The other input of AND gate 276 is held high inside the needle selection range by the output 303 of the needle selecting range circuit H. Thus, the gate 276 enables further AND gate 270 with a high potential given selection of either the *p* or *n* position of needle mode reversing means *p* and while the carriage is inside the needle selecting range.

The switch P in its usual position *p* applies a low potential to the remaining input of EXCLUSIVE OR gate 268 causing the latter to pass the needle selecting signals from the recording and reading-out control circuit F. On the other hand, with the switch P otherwise positioned (in its inactive position *i* or reversing position *n*), a high potential appears on the rightward input of EXCLUSIVE OR gate 268 such that the needle selecting signals therethrough are inverted. The AND gate 270, when enabled as aforesaid by gate 276, passes the noninverted or inverted needle selecting signals from recording and reading out control circuit F to an amplifier comprising transistors 271 and 272 which provide the drive signal for selection of needles at the output of drive signal forming circuit L. Such output is connected, as shown, to the conducting band 30 of the needle bed X. Electrical connection of the band 30 to the electromagnets of the needle selecting mechanisms C*l* and C*r* on the carriage is illustratively shown in FIG. 5, including the switch means E*l* and E*r* shown in FIG. 10.

In the preceding discussion of FIGS. 12, 13 and 15, attention has been primarily directed to reading out of data from the temporary storing units MEM. Attention is now directed to storing of needle selection data from the program carrier. As above mentioned, the recording address assigning circuit G includes an up-down counter, seen in FIG. 14 at 254, and which preferably is similar to above-mentioned counter 212. The counter 254 counts up during one direction of carriage movement and counts down during the opposite direction of carriage movement. Particularly, the countdown and countup clock pulse inputs CpD and CpU, respectively, receive sampling pulses during opposite directions of carriage movement (one receiving a series of sampling pulses while the other is idle) and respectively connect to the outputs of NAND gates 256 and 255, respectively. Each such NAND gate receives sampling pulses from the sampling pulse generator $a_1$. Output line 301 of the carriage running direction detecting means *d* connects directly to downcount NAND 256 to enable same for sample pulse feeding in one direction of carriage movement, and such output 301 connects through an inverter to the enabling input of downcount NAND gate 255 to enable same for sampling pulse feeding in the opposite direction of carriage movement. The master reset (clear) input MR of the up-down counter 254 resets counter 254 when the support 5 rotates the program carrier 1 an increment. More particularly, program carrier feeding switch members 17*l* and 17*r* above discussed are also shown in FIG. 14 as normally open switches connected between ground and (through a dropping resistor) to positive voltage supply V*cc*, with switch output being taken on the high voltage side of the corresponding switch member 17*l* or 17*r*. In the embodiment shown, the output of program carrier feeding switch 17*l* connects through an inverter 253 to said master reset terminal MR of counter 254.

The parallel output of counter 254 is taken on the path 307 above discussed with respect to recording and reading-out control circuit F and storage MEM of FIG. 15 for reading needle selection data from the program carrier 1 into temporary storage MEM.

FIG. 14 additionally discloses preferred details of circuitry associated with the program providing means and not specifically illustrated in FIG. 10, such including a function discriminator circuit DS, a feed control circuit FC and a feed drive circuit FD.

The function discriminator DS is adapted to discriminate the reading out of a mark arbitrarily recorded in the column $11_3$ (FIG. 2) of the program carrier 1. The function discriminator DS includes a binary counter (here a four bit binary counter) 238 having a clear terminal R connected through an inverter 239 to the left switch member 17*l* for clearing of counter 238 once in each reciprocation of carriage Y. The output of sampling pulse generator $a_2$ which pulses once for each data space in column $11_3$ passed by the scanner 2 is connected to the clock input Cp of binary counter 238 such that the sampling pulse generator $a_2$ provides serially into the counter pulses corresponding to data spaces of column $11_3$ of the program carrier, as said scanner moves horizontally across the program carrier. The binary counter 238 has parallel outputs indicated at B, C and D. The latter feed the parallel inputs A, B and C of a binary to decimal decoder 240. Remaining input D of decoder 240 connects through an inverter 239A to the output of sampling pulse generator $a_2$.

The parallel decimal outputs 0–5 of decoder 240 connect as shown through negated input Orgates 241, 242 and 243 to the clock inputs Cp of D-type flip-flops 244, 245 and 246, respectively. The clock inputs of flip-flops 244, 245 and 246 thus respectively respond to decoder outputs 0 and 5, 1 and 4, and 2 and 3.

On the other hand, the conditioning input D of each flip-flop 244–246 connects through an inverter 247 to the output of scanner 2 such that signals representative of data read out of the program carrier, particularly the left-hand side three subcolumns of the column $11_3$ thereof are clocked into flip-flops 244–246, respectively. The Q outputs of the flip-flops 244–246 drive respective displays and/or alarm devices of any conventional type not shown. The Q outputs of two flip-flops 244 and 245 may connect (not illustrated as such in FIG. 14) additionally to the feed control circuit FC such that they may condition the latter to determine the feeding direction of of the program carrier where a bidirectional feeding mechanism is employed, wherein the associated displays may indicate said feeding direction of the program carrier. An alarm device may be connected to the last flip-flop 246, and it may be used by a machine operator for any object, for example, for detecting, during knitting, that the time has come when a knitting yarn is to be changed for another yarn for color changing object, etc. In this way, the function mark read by scanner 2 in one pass across column $11_3$ of the program carrier will result in a corresponding display at the output of the function discriminator circuit DS.

Meanwhile, output signals out of the scanner 2 representative of data in the column $11_2$ and the rightmost subcolumn of the column $11_3$ of the program carrier may be sampled by the outputs of the switches **17*l* and 17*r***, respectively, and ma be adapted to condition the feed control circuit FC in a different manner from the above, which, however, will not be mentioned herein since it is not within the scope of the present invention.

Rotational advancement of the support 5, and hence of the program carrier 1 supported thereby, is accomplished by the feed control circuit FC and the feed drive circuit FD controlled thereby. More particularly, the switch members **17*l* and 17*r* (FIG. 14) actuated by plates 18*l* and 18*r* as the carriage Y nears to its leftward and rightward end positions, provide corresponding electrical signals. In the FIG. 14 embodiment, these signals are voltage lows and are applied through the negated input NOR gate 250 and series capacitor 249 to the negated input of a monostable multivibrator 248 in the feed control circuit FC. Accordingly, the monostable multivibrator 248 at its output terminal Q provides an output pulse to the feed drive circuit FD, and more particularly the drive transistor 252 thereof, which in turn connects to a suitable feed magnet (not shown) arranged in a convenient manner to rotatably advance the support 5 and program carrier 1 carried thereby. In the preferred embodiment shown, the feed control FC also includes a normally open, manually closeable stepping feed switch 251 which through the RC and inverter network 251A may be used to manually actuate (at input T) the monostable multivibrator 248, for manually rotatably advancing the program carrier 1**.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A patterning system in a straight knitting machine having a main body provided thereon with a needle bed for knitting needles and a carriage slidably mounted on said needle bed, comprising, in combination, needle selection means including an electromagnet for selectively operating said knitting needles, control circuit means including an erasable temporary storage for selective energization of said electromagnet, a program providing means provided on said main body for providing signals representative of data for needle selection, and input means for providing control signals for conditioning said control circuit means, said program providing means including a program carrier carrying thereon a needle selection program, a support on said main body for removably mounting thereon said program carrier and adapted to be driven to rotate around a longitudinal axis thereof to incrementally feed said program carrier in one or the other direction, a scanner mounted for movement in a predetermined path between two end positions in response to each of the directional movements of said carriage, said scanner having thereon a sensor means for reading the needle selection program on said program carrier on said support, and pulse generating means for generating an interval pulse by an increment of the scanner movement to provide a predetermined number of pulses upon a scanner movement between said two end positions.

2. A patterning system as claimed in claim 1, wherein said program providing means further includes a switch member electrically connected to said control circuit means and provided in a position with at least one of said two end positions of the path for detecting whether said scanner is currently positioned in the end position or not.

3. A patterning system as claimed in claim 2, wherein said switch member is of the type which is responsive to magnetic fields, and said scanner has a piece of permanent magnet mounted thereon.

4. A patterning system as claimed in claim 1, wherein said pulse generating means of said program providing means comprises a fixed member mounted in parallel with said path of said scanner and having thereon a plurality of interval markings, and a photoelectronic reading head mounted on said scanner for reading said markings on said fixed member, said reading head including a light source and a photoelectric transducer.

5. A patterning system as claimed in claim 4, wherein said interval markings of said fixed member are in the form of interval slots formed thereon.

6. A patterning system as claimed in claim 1, wherein said scanner is slidably mounted on a pair of guide bars which are arranged in parallel with each other and also with said longitudinal axis of said support.

7. A patterning system as claimed in claim 1, wherein said path of said scanner is arranged in parallel with the passage of said carriage, and means is provided for temporarily coupling said scanner to said carriage whereby said scanner is moved by and together with said carriage between said two end positions.

8. A patterning system as claimed in claim 7, wherein said means for temporarily coupling said scanner to said carriage includes a magnet mounted on either one of said scanner and said carriage, and a ferromagnetic member mounted on the other of the two not mounting said magnet.

9. A patterning system as claimed in claim 1, wherein said program carrier is provided thereon with a column to fill therein with a mark indicative of one of machine operations, the contents in said column also being read by said sensor means on said scanner.

10. A patterning system in a straight knitting machine having a main body provided thereon with a needle bed for knitting needles and a carriage slidably mounted on said needle bed, comprising, in combination, needle selection means including an electromagnet for selectively operating said knitting needles, a program providing means provided on said main body and operable in response to a directional movement of said carriage relative to said needle bed to provide a predetermined number of signals representative to data for needle selection for a course of knitting, said program providing means including a program carrier carrying thereon a needle selection program and adapted to be fed from line to line, said program providing means further including a reading head for reading said needle selection program on the program carrier along a line, control circuit means for selective energization of said electromagnet and including an erasable temporary storage for temporarily storing therein said signals provided by said program providing means, and input means for providing control signals for conditioning said control circuit means, said input means including preset means for selectively presetting the number of those signals which are to be cyclically read out of said storage, the latter number being not larger than the former predetermined number in value.

11. A patterning system as claimed in claim 10, wherein said preset means includes a manually operable member electrically connected to said control circuit means.

12. A patterning system in a straight knitting machine having a main body provided thereon with a needle bed for knitting needles and a carriage slidably mounted on said needle bed, comprising, in combination, needle selection means including an electromagnet for selectively operating said knitting needles, input means for providing control signals, and control circuit means for selective energization of said electromagnet and electrically connected to said input means, said control circuit means including a program memory having therein signals representative of data for needle selection at least for a course of knitting, said control circuit means further including read-out means for reading said signals out of said program memory in response to said control signals provided by said input means, said input means including a defining means for defining a range in which needle selection is to be effective in accordance with signals read out of said program memory, said defining means including a pair of boundary members mounted on and manually displaceable relative to said needle bed.

13. A patterning system as claimed in claim 12, wherein said program membory is an erasable temporary memory, and the patterning system further comprises a program providing means for providing the signals representative of data for needle selection, said program providing means including a program carrier carrying thereon a needle selection program and reading means for reading said needle selection program on the program carrier.

14. A patterning system as claimed in claim 12, wherein each of said boundary members includes a switch member responsive to magnetic fields, and the carriage is provided with a piece of magnet for operation of the switch members.

15. A patterning system as claimed in claim 12, wherein one of said pair of boundary members is adapted to be a reference means for determining the knitting needle in reference.

16. A patterning system as claimed in claim 12, wherein said input means includes a manually operable member adapted to be manually operated to reverse the sequence of the reading out of the signals out of said program memory.

17. A patterning system in a straight knitting machine having a main body provided thereon with a needle bed for knitting needles and a carriage slidably mounted on said needle bed, comprising, in combination, needle selection means including an electromagnet for selectively operating said knitting needles, input means for providing control signals, control circuit means electrically connected with said input means and said electromagnet for selective energization of the latter for needle selection in accordance with a program, and a shiftable member mounted for limited shifting movement on and relative to said carriage through frictional engagement with said needle bed, one of said input means being a switch operatively associated with said shiftable member.

18. A patterning system as claimed in claim 17, wherein said shiftable member includes a piece of permanent magnet, and said needle bed is partially made of a ferromagnetic material.

19. A patterning system in a straight knitting machine having a main body provided thereon with a needle bed for knitting needles and a carriage slidably mounted on said needle bed, comprising, in combination, a pair of needle selection means mounted on said carriage in a spaced relation from each other and each provided with an electromagnet, input means for providing control signals, control circuit means electrically connected with said input means and the electromagnets for selective energization of said electromagnets for needle selection in accordance with a program, a shiftable member mounted for limited shifting movement on and relative to said carriage through frictional engagement with said needle bed, and a switch means provided in association with said shiftable member and operative in response to shifting movement of said shiftable member to electrically connect said control circuit means alternatively to said electromagnets.

20. A patterning system in a straight knitting machine having a main body provided thereon with a needle bed for knitting needles and a carriage slidably mounted on said needle bed, comprising, in combination, needle selection means mounted on said carriage and including an electromagnet, input means for providing control signals, control circuit means on said main body for selective energization of said elctromagnet for needle selection, a program providing means provided on said main body for providing signals representative of data for needle selection, said control circuit means including an erasable temporary storage for storing therein said signals provided by said program providing means, and means for establishing on electric connection between said control circuit means on said main body and said electromagnet on said carriage without an connecting cable or the like, the establishing means including a conducting band mounted on and extending along the length of said main body, and a current collector means mounted on said carriage for usual sliding engagement with said conducting band.

21. A patterning system as claimed in claim 20, wherein said current collector means includes a permanent magnet, and said conducting band is made of a ferromagnetic material.

* * * * *